US008220250B2

(12) United States Patent
Hokuto

(10) Patent No.: US 8,220,250 B2
(45) Date of Patent: Jul. 17, 2012

(54) INTERNAL COMBUSTION ENGINE AND METHOD OF CONTROLLING THE SAME

(75) Inventor: Hiroyuki Hokuto, Numazu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 807 days.

(21) Appl. No.: 12/096,957

(22) PCT Filed: Dec. 12, 2006

(86) PCT No.: PCT/IB2006/003566

§ 371 (c)(1),
(2), (4) Date: Jun. 11, 2008

(87) PCT Pub. No.: WO2007/069032

PCT Pub. Date: Jun. 21, 2007

(65) Prior Publication Data

US 2009/0000276 A1 Jan. 1, 2009

(30) Foreign Application Priority Data

Dec. 14, 2005 (JP) ..... 2005-360361

(51) Int. Cl.
*F01N 3/20* (2006.01)

(52) U.S. Cl. ..... 60/285; 60/274; 60/276; 60/283; 60/286; 60/295

(58) Field of Classification Search ..... 60/274, 60/276, 283, 285, 286, 295
See application file for complete search history.

(56) References Cited

U.S. PATENT DOCUMENTS 6,467,259 B1 * 10/2002 Surnilla et al. ..... 60/285
6,543,219 B1 * 4/2003 Surnilla ..... 60/285
6,955,155 B2 * 10/2005 Surnilla ..... 123/339.11
7,159,387 B2 * 1/2007 Surnilla et al. ..... 60/285
7,503,167 B2 * 3/2009 Jankovic ..... 60/285
2003/0172647 A1 * 9/2003 Tanaka ..... 60/286
2003/0221660 A1 * 12/2003 Surnilla et al. ..... 123/295
2005/0262828 A1 * 12/2005 Iihoshi et al. ..... 60/277
2007/0113541 A1 * 5/2007 Jankovic ..... 60/285

FOREIGN PATENT DOCUMENTS

| | | |
|---|---|---|
| EP | 1 061 244 | 12/2000 |
| EP | 1 106 815 | 6/2001 |
| JP | 4 365920 | 12/1992 |
| JP | 8 177572 | 7/1996 |
| JP | 11 36998 | 2/1999 |
| JP | 2000 230445 | 8/2000 |

* cited by examiner

*Primary Examiner* — Kenneth Bomberg
*Assistant Examiner* — Jorge Leon, Jr.
(74) *Attorney, Agent, or Firm* — Oblon, Spivak, McClelland, Maier & Neustadt, L.L.P.

(57) ABSTRACT

Cylinders of an internal combustion engine are divided into at least two cylinder groups. First air-fuel ratio sensors are disposed in each exhaust branch pipe connected to the cylinder groups, and a second air-fuel ratio sensor is disposed in a common exhaust pipe upstream from the catalyst. When a vapor amount introduced into an intake passage during purge control is determined, the vapor amount is determined during normal operation using output values from the first air-fuel ratio sensors and the vapor amount value learned during normal operation. During rich-lean operation, the vapor amount is determined using the output value from the second air-fuel ratio sensor and the vapor amount value learned during rich-lean operation. Thereby, the vapor amount introduced into the intake passage when a switch is made from normal to rich-lean operation of the internal combustion engine is accurately determined.

8 Claims, 12 Drawing Sheets

CALCULATE FAF
50
FEEDBACK CONDITION SATISFIED ?
NO
YES
FAF←1.0
59
FAFAV←1.0
60
51
I < 0 ?
NO
YES
52
PREVIOUS TIME LEAN ?
NO
YES
61
PREVIOUS TIME RICH ?
NO
YES
FAFL←FAF
53
FAFR←FAF
62
FAF←FAF-S
54
FAF←FAF+S
63
FAFAV← (FAFL+FAFR)/2
55
SET SKIP FLAG
56
58
FAF←FAF-K
64
FAF←FAF+K
GUARD FAF WITH 1.2, 0.8
57
TO AIR-FUEL RATIO LEARNING ROUTINE

INTERNAL COMBUSTION ENGINE AND METHOD OF CONTROLLING THE SAME

BACKGROUND OF THE INVENTION

1. Field of the Invention

The present invention relates to an internal combustion engine and a method of controlling the internal combustion engine.

2. Description of the Related Art

Japanese Patent Publication No. 2000-230445 (JP-A-2000-230445) describes an internal combustion engine having a plurality of cylinders divided into two cylinder groups, and exhaust pipes, connected in association with each cylinder group, which are joined downstream into a common exhaust pipe. In the described internal combustion engine, a three-way catalyst is disposed in the exhaust pipes connected to each cylinder group, and another three-way catalyst is disposed in the common exhaust pipe. A control is performed to correct the amount of fuel injected from a fuel injection valve (hereinafter "fuel injection amount") so that the air-fuel ratio is maintained at the target air-fuel ratio, based on the air-fuel ratio detected by air-fuel ratio sensors (indicated as 13L and 13R in FIG. 1 of the cited reference, hereinafter "upstream sensors") disposed upstream of the upstream three-way catalysts. According to the cited document, when a prescribed condition is satisfied, fuel vapor is discharged to the intake pipe from a canister that holds evaporated fuel generated in the fuel tank.

Because the fuel vapor that is discharged to the intake pipe from the canister is ultimately taken into a cylinder and combusted, the fuel vapor affects the air-fuel ratio. In the internal combustion engine described in JP-A-2000-230445, a correction coefficient that corrects the fuel injection amount to maintain the air-fuel ratio at the target air-fuel ratio is determined based on the air-fuel ratio detected by the upstream air-fuel ratio sensors. The proportion of fuel vapor included in the gas ejected from the canister into the intake pipe (hereinafter "fuel vapor concentration") is determined based on the correction coefficient, and the fuel injection amount is controlled to maintain the air-fuel ratio at the target air-fuel ratio, based on the determined fuel vapor concentration.

However, in the internal combustion engine described in JP-A-2000-230445, in order to increase the temperature of the downstream three-way catalyst, there is a need not only to supply a relatively large amount of fuel and air to the three-way catalyst, but also to make the air-fuel ratio of the exhaust gas flowing into the three-way catalyst be the stoichiometric air-fuel ratio. A known means for satisfying this need is to cause combustion in one cylinder group at an air-fuel ratio that is richer than the stoichiometric air-fuel ratio and cause combustion in the other cylinder group at an air-fuel ratio that is leaner than the stoichiometric air-fuel ratio, so that the air-fuel ratio of the exhaust gas flowing into the three-way catalyst is the stoichiometric air-fuel ratio.

When causing combustion in one cylinder group at an air-fuel ratio richer than the stoichiometric air-fuel ratio and causing combustion in another cylinder group at an air-fuel ratio leaner than the stoichiometric air-fuel ratio (hereinafter "rich-lean operation"), the air-fuel ratio of exhaust gas flowing into the upstream three-way catalyst may be rich or lean. Therefore, even if an attempt is made to maintain the air-fuel ratio in each of the cylinder groups at the stoichiometric air-fuel ratio based on the air-fuel ratio detected by the upstream sensors, it is not possible to maintain the air-fuel ratio accurately at the stoichiometric air-fuel ratio. As a result, it is known that the air-fuel ratio for each of the cylinder groups is maintained at the stoichiometric air-fuel ratio based on the air-fuel ratio detected by an air-fuel ratio sensor disposed in the upstream from three-way catalyst that is downstream from the point of joining of the exhaust gas from one cylinder group and the exhaust gas from the other cylinder group (referred to as the downstream sensor and assigned the reference numeral 16 in JP-A-2000-230445).

In the internal combustion engine described in JP-A-2000-230445, the fuel vapor concentration is determined based on a correction coefficient that corrects the fuel injection amount, so that the air-fuel ratio is maintained at the stoichiometric air-fuel ratio. When rich-lean operation is not performed (hereinafter "normal operation"), the fuel vapor concentration is determined based on a correction coefficient with respect to the fuel injection amount determined based on the air-fuel ratio detected by the upstream sensor, and during the rich-lean operation, the fuel vapor concentration is determined based on a correction coefficient with respect to the fuel injection amount determined based on the air-fuel ratio detected by the downstream sensor.

The fuel vapor concentration detection during normal operation of the internal combustion engine is performed at fixed time intervals. When this is done, the determined fuel vapor concentration is generally stored as a learned value, and the learned value of fuel vapor concentration that was stored the immediately preceding cycle is used to determine the fuel vapor concentration in subsequent cycles. In this case, immediately after the operation of the internal combustion engine switches from normal operation to rich-lean operation, the fuel vapor concentration is determined using the learned value of fuel vapor concentration determined when performing normal operation. However, because the fuel vapor concentration is determined during normal operation using the upstream sensor output, when the operation of the internal combustion engine switches to rich-lean operation, the fuel vapor concentration is determined based on the learned value of fuel vapor concentration determined based on the output of the upstream sensor and on the output of the downstream sensor.

Given the above, even if the upstream sensors and downstream sensor are of the same type, and especially if they are of different types, there is an inherent difference in the output characteristics thereof. Therefore, when the operation of the internal combustion engine switches from normal operation to rich-lean operation, it is not possible to accurately determine the fuel vapor concentration by determining the fuel vapor concentration during rich-lean operation using the learned value of fuel vapor concentration determined during normal operation.

SUMMARY OF THE INVENTION

The present invention accurately determines the fuel vapor amount introduced into the intake passage even when the operation of the internal combustion engine is switched from normal operation to rich-lean operation.

A first aspect of the present invention relates to an internal combustion engine having a plurality of cylinders divided into at least two cylinder groups; a plurality of exhaust branch pipes, joined downstream, each connected to a cylinder group of the plurality of cylinder groups; a common exhaust pipe connected to the downstream joining portion of the plurality of exhaust branch pipes; and an exhaust gas purifying catalyst disposed in the common exhaust pipe. The internal combustion engine according to this aspect usually performs normal operation, which causes combustion in each cylinder group with a prescribed air-fuel ratio, and performs rich-lean operation, which causes combustion in one cylinder group at an air-fuel ratio richer than the stoichiometric air-fuel ratio and causes combustion in another cylinder group at an air-fuel ratio leaner than the stoichiometric air-fuel ratio, when there is a need to supply a reducing agent and air to the exhaust gas purifying catalyst, so that exhaust gas having a prescribed air-fuel ratio flows into the exhaust gas purifying catalyst. Furthermore, when a prescribed condition is established, the internal combustion engine performs a purge control introducing a gas including fuel vapor into an intake passage leading to all the cylinders, and determines and stores records an amount of fuel vapor introduced into the intake passage during the purge control as a learned value. Furthermore, the internal combustion engine has first air-fuel ratio sensors disposed in each of the exhaust branch pipes, and a second air-fuel ratio sensor disposed in the common exhaust pipe, upstream from the exhaust gas purifying catalyst. When determining the fuel vapor amount introduced into the intake pipes during purge control, the internal combustion engine determines, during normal operation, the fuel vapor amount using an output value of the first air-fuel ratio sensor and a fuel vapor amount determined and recorded as a learned value of the fuel vapor amount during normal operation, and determines, during rich-lean operation, the fuel vapor amount using an output value of the second air-fuel ratio sensor and a fuel vapor amount determined and recorded as a learned value of the fuel vapor amount during rich-lean operation.

The purge control may be stopped when operation of the internal combustion engine switches from normal operation to rich-lean operation, or when operation of the internal combustion engine switches from rich-lean operation to normal operation. The purge control may then be restarted after a prescribed period of time has elapsed.

When normal operation is performed, the air-fuel ratio in each cylinder group may be controlled to be a target air-fuel ratio using the output value of the first air-fuel ratio sensor. Likewise, when rich-lean operation is performed, the air-fuel ratio in each cylinder group may be controlled to be a target air-fuel ratio using the output value of the second air-fuel ratio sensor.

Additional exhaust gas purifying catalysts may be provided in each exhaust branch pipe, downstream from the first air-fuel ratio sensors.

According to the internal combustion engine of the first aspect of the present invention, because separate fuel vapor amounts are determined during normal operation and during rich-lean operation, the fuel vapor amount is accurately determined in both when there is a switch of the operation of the internal combustion engine from rich-lean operation to normal operation, and when there is a switch of the operation of the internal combustion engine form normal operation to rich-lean operation.

A second aspect of the present invention is a method of controlling an internal combustion engine having a plurality of cylinders divided into at least two cylinder groups;

a plurality of exhaust branch pipes, joined downstream, each connected to a cylinder group of the plurality of cylinder groups;

a common exhaust pipe connected to the downstream joining portion of the plurality of exhaust branch pipes;

an exhaust gas purifying catalyst disposed in the one common exhaust pipe;

first air-fuel ratio sensors disposed in each of the exhaust branch pipes; and a second air-fuel ratio sensor disposed in the one common exhaust pipe upstream from the exhaust gas purifying catalyst; and a controller that usually performs normal operation, which causes combustion in each cylinder group with a prescribed air-fuel ratio, performs rich-lean operation, which causes combustion with an air-fuel ratio richer than the stoichiometric air-fuel ratio in one cylinder group and causes combustion with an air-fuel ratio leaner than the stoichiometric air-fuel ratio in another cylinder group, when there is a need to supply a reducing agent and air to the exhaust gas purifying catalyst, so that exhaust gas having a prescribed air-fuel ratio flows into the exhaust gas purifying catalyst, and when a prescribed condition is established, performs purge control introducing a gas including a vapor into an intake passage leading to all the cylinders, and determines and records an amount of vapor introduced into the intake passage during the purge control as a learned value, this method having the steps of:

determining whether purge control is in progress or not;

determining whether normal operation is being performed or rich-lean operation is being performed; and determining the vapor amount using an output value of the first air-fuel ratio sensor and a vapor amount determined and recorded as a learned value of vapor amount during normal operation when determining the vapor amount introduced into the intake pipes during purge control and normal operation, and determining the vapor amount using an output value of the second air-fuel ratio sensor and a vapor amount determined and recorded as a learned value of vapor amount during rich-lean operation when determining the vapor amount introduced into the intake pipes during purge control and rich-lean operation.

The second aspect of the present invention, by separately determining the vapor amount for the case of normal operation and rich-lean operation, accurately determines the vapor amount in both the case in which engine operation is switched from normal to rich-lean, and the case in which engine operation is switched from rich-lean to normal.

BRIEF DESCRIPTION OF THE DRAWINGS

The foregoing and further objects, features, and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
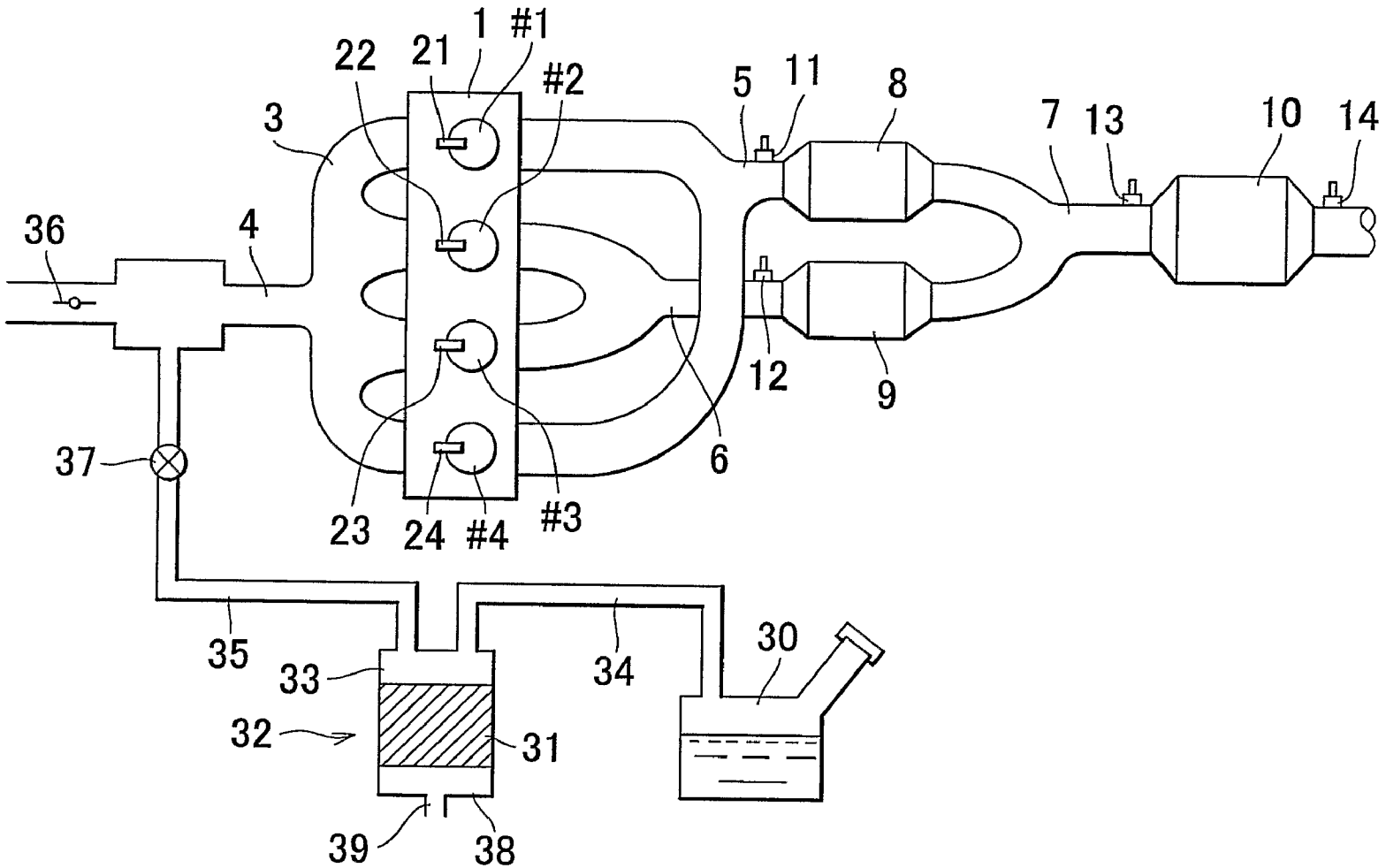
FIG. 1 is a drawing showing an example of an internal combustion engine having a exhaust gas purifying apparatus according to the present invention.

Embodiments of the present invention are described below with reference to the drawings. FIG. 1 shows an internal combustion engine having an exhaust gas purifying apparatus. In FIG. 1 reference numeral 1 represents an internal combustion engine itself, and #1 through #4 represent the first cylinder, the second cylinder, the third cylinder, and the fourth cylinder, respectively. These cylinders have fuel injection valves 21, 22, 23, 24. An intake pipe 4 is connected to each of the associated cylinders via an intake branch pipe 3. A first exhaust branch pipe 5 is connected to the first cylinder and the fourth cylinder, and a second exhaust branch pipe 6 is connected to the second cylinder and the third cylinder. That is, if the first cylinder and the fourth cylinder are collectively called the first cylinder group, and the second cylinder and the third cylinder are collectively called the second cylinder group, the first exhaust branch pipe 5 is connected to the first cylinder group and the second exhaust branch pipe 6 is connected to the second cylinder group. These exhaust branch pipes 5, 6 are joined further downstream and are connected to a single common exhaust pipe 7.

The first exhaust branch pipe 5 has a downstream portion that is a single exhaust pipe and an upstream portion where it is branched into two, one of the two exhaust branch pipes is connected to the first cylinder and the other exhaust branch pipe is connected to the fourth cylinder. Likewise, the second exhaust branching pipe 6 has a downstream portion that is a single exhaust pipe and an upstream portion where it is branched into two, one of the two branched exhaust branch pipes is connected to the second cylinder and the other exhaust branch pipe is connected to the third cylinder. In the description to follow, when referring specifically to the upstream portions of the exhaust branch pipes 5, 6, which are divided into two, these will be referred to as the "branched portion of the exhaust branching pipe," and when referring specifically to single piped downstream portion of the exhaust branching pipes 5, 6, these will be referred to as the "joined portion of the exhaust branching pipe."

Three-way catalysts 8, 9 are disposed in the joined portions of the exhaust branch pipes 5, 6, respectively, and a NOx catalyst is disposed in the exhaust pipe 7. Also, air-fuel ratio sensors 11, 12 are disposed upstream from the three-way catalysts 8, 9, which are disposed in the joined portions of the exhaust branch pipes 5, 6, respectively. Also air-fuel ratio sensors 13, 14 are disposed in the exhaust pipe 7, respectively, upstream and downstream from the NOx catalyst 10.

Figure 2:
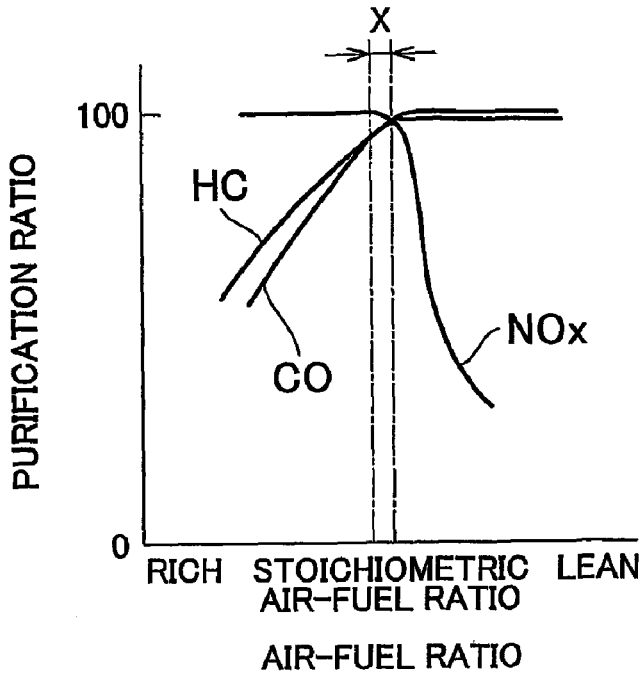
FIG. 2 is a drawing showing the purifying characteristics of a three-way catalyst.

As shown in FIG. 2, when the temperature of the three-way catalysts 8, 9 exceeds a certain temperature (the activation temperature) and the air-fuel ratio of the exhaust gas flowing into the three-way catalyst is the stoichiometric air-fuel ratio (the region X in FIG. 2), nitrogen oxides (NOx), carbon monoxide (CO), and hydrocarbon (HC) are simultaneously removed from the exhaust gas simultaneously at a high purification rate. The three-way catalyst exhibits oxygen storage/release capacity, such that, if the air-fuel ratio of the exhaust gas flowing into the three-way catalyst is leaner than the stoichiometric air-fuel ratio, oxygen in the exhaust gas is absorbed by the three-way catalyst, and if the air-fuel ratio of the exhaust gas flowing into the three-way catalyst is richer than the stoichiometric air-fuel ratio, the stored oxygen is released. As long as this oxygen storage/release capacity is provided, regardless of whether the air-fuel ratio of the exhaust gas flowing in is leaner or richer than the stoichiometric air-fuel ratio, because the air-fuel ratio of the atmosphere within the three-way catalyst is maintained substantially in the region of the stoichiometric air-fuel ratio, NOx, CO, and HC in the exhaust gas are simultaneously purified with a high purification rate.

If the temperature of the NOx catalyst 10 is at or above the activation temperature and the air-fuel ratio of the exhaust gas flowing thereinto is leaner than the stoichiometric air-fuel ratio, NOx in the exhaust gas is absorbed by the catalyst, but if the air-fuel ratio of the exhaust gas flowing into the three-way catalyst is at or below the stoichiometric air-fuel ratio, the absorbed NOx is reduced and purified.

Under conditions where the NOx catalyst 10 absorbs NOx, the NOx catalyst 10 will also absorb any SOx present in the exhaust gas. If SOx is absorbed by the NOx catalyst 10, the amount of NOx that the NOx catalyst can absorb is commensurately reduced. For this reason, in order to maintain the NOx absorption capacity of the NOx catalyst as high as possible, it is necessary to remove the SOx from the NOx catalyst. Thus, when the temperature of the NOx catalyst is at a temperature at which SOx can be removed, if the air-fuel ratio of the exhaust gas is stoichiometric or rich (preferably very close to the stoichiometric air-fuel ratio) is supplied to the NOx catalyst, it is possible to remove the SOx from the NOx catalyst 10. Stated differently, when the NOx catalyst is at a certain temperature and the exhaust gas having an air-fuel ratio that is the stoichiometric air-fuel ratio or a rich air-fuel ratio is supplied to the NOx catalyst, the NOx catalyst of this embodiment releases SOx.

Thus, when it is necessary to remove SOx from the NOx catalyst 10, a sulfur poisoning recovery control is executed, so that the temperature of the NOx catalyst 10 reaches the temperature at which SOx is removed and exhaust gas having the stoichiometric air-fuel ratio or a rich air-fuel ratio is supplied to the NOx catalyst 10. That is, during the sulfur poisoning recovery control of this embodiment, the air-fuel ratio of the gas mixture filled into each cylinder is controlled so that exhaust gas having a rich air-fuel ratio (hereinafter "rich exhaust gas") is discharged from the first cylinder and the fourth cylinder (that is, the first cylinder group), and exhaust gas having a lean air-fuel ratio (hereinafter "lean exhaust gas") is discharged from the second cylinder and the third cylinder (that is, the second cylinder group).

The degree of richness of the rich exhaust gas and the degree of leanness of the lean exhaust gas discharged from each of the cylinders are adjusted so that, when the rich exhaust gas and lean exhaust gas mix together upstream from the NOx catalyst 10 and flow into the NOx catalyst, adjustment is done so that the overall air-fuel ratio of the exhaust gas is the stoichiometric air-fuel ratio or a desired rich air-fuel ratio.

Because the temperature at which SOx is removed from an NOx catalyst 10 is generally higher than the temperature at which NOx is absorbed by or reduced and purified in the NOx catalyst, it is necessary to raise the temperature of the NOx catalyst to remove the SOx. With regard to this, by executing a sulfur poisoning recovery control of this embodiment to mix the rich exhaust gas and the lean exhaust gas, the reaction between HC in the rich exhaust gas and oxygen in the lean exhaust gas generates a heat of reaction that contributes to increasing the temperature of the NOx catalyst to the temperature at which SOx can be removed.

As described above, in order to remove SOx from the NOx catalyst 10, the air-fuel ratio of the exhaust gas flowing into the NOx catalyst must be stoichiometric or rich. With regard to this, according to the sulfur poisoning recovery control of this embodiment, the air-fuel ratio of the exhaust gas flowing into the NOx catalyst is either the stoichiometric air-fuel ratio or a rich air-fuel ratio. If the sulfur poisoning recovery control of this embodiment is executed, it is possible to remove SOx from the NOx catalyst 10.

Also, the air-fuel ratio of the rich exhaust gas discharged from each of the cylinders during the sulfur poisoning recovery control may be a rich air-fuel ratio close to the stoichiometric air-fuel ratio, and therefore the air-fuel ratio of the lean exhaust gas discharged from each cylinder in the sulfur poisoning recovery control may be a lean air-fuel ratio close to the stoichiometric air-fuel ratio.

Figure 3:
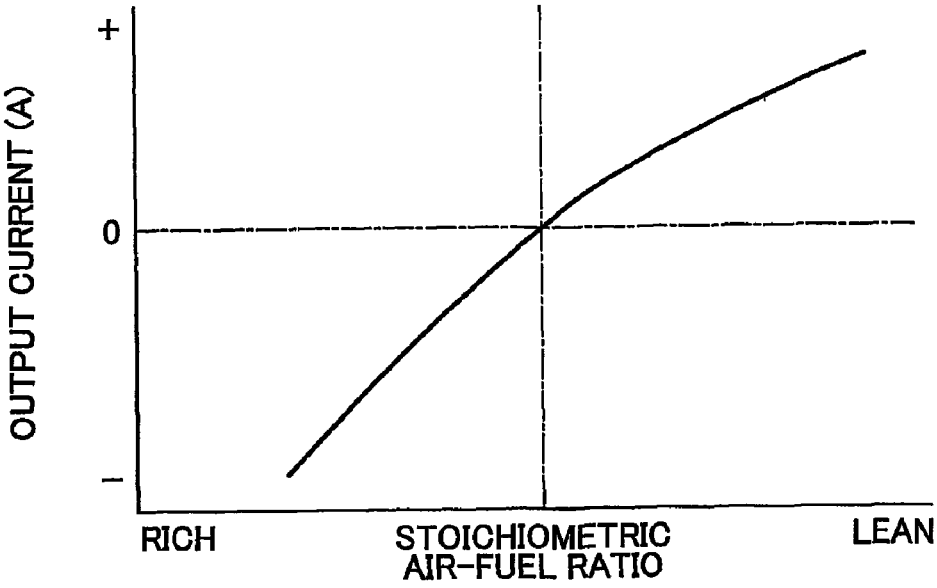
FIG. 3 is a drawing showing the output characteristics of linear air-fuel ratio sensor.

A linear air-fuel ratio sensor may be provided, which outputs a current that varies linearly in response to the air-fuel ratio of the exhaust gas, outputs a current having the characteristics shown in FIG. 3 is one air-fuel ratio sensor. The linear air-fuel ratio sensor outputs a current of 0 A when the air-fuel ratio of the exhaust gas is stoichiometric, outputs a current lower than 0 A when the air-fuel ratio of the exhaust gas is richer than the stoichiometric air-fuel ratio, and outputs a current higher than 0 A when the air-fuel ratio of the exhaust gas is leaner than the stoichiometric air-fuel ratio. That is, the linear air-fuel ratio sensor outputs a current that varies linearly in response to the air-fuel ratio of the exhaust gas.

Figure 4:
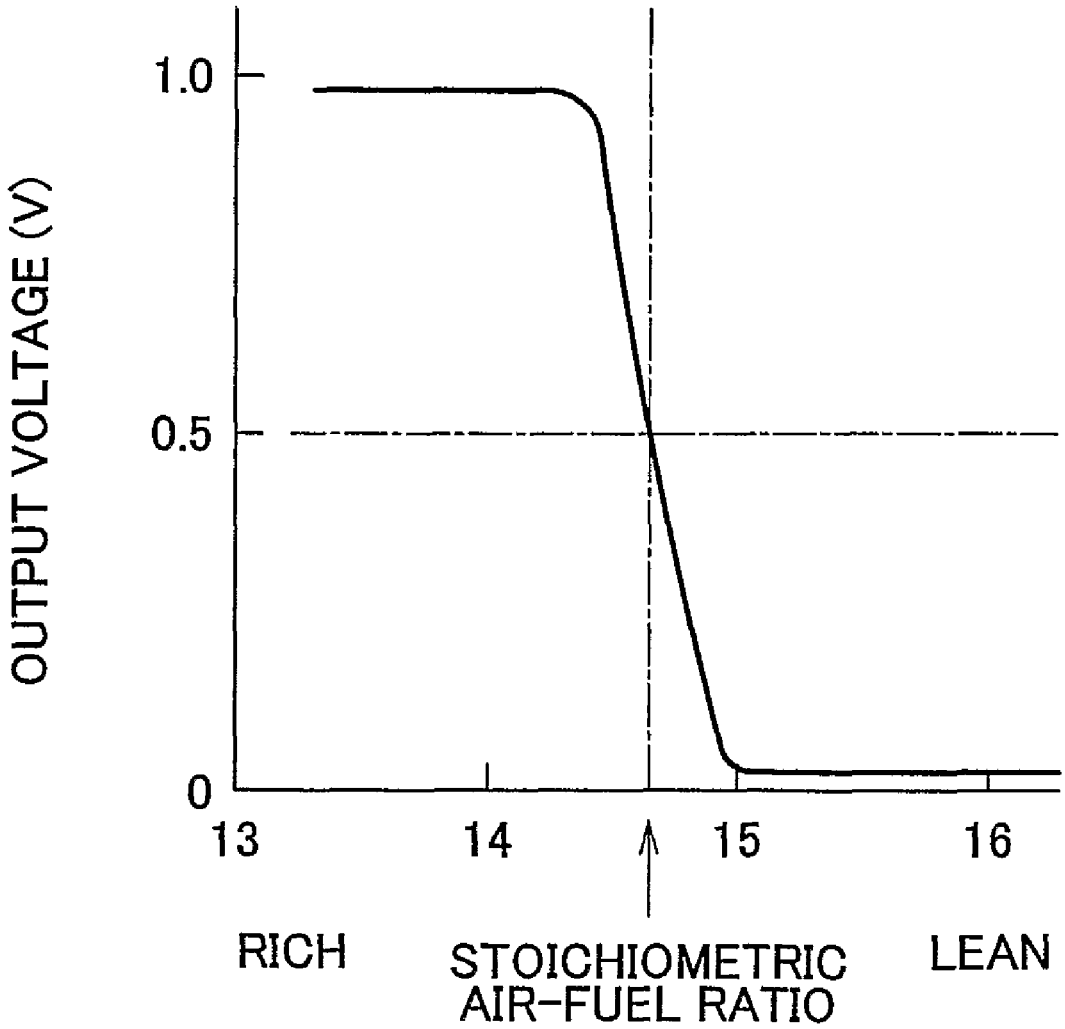
FIG. 4 is a drawing showing the output characteristics of an $O_2$ sensor.

Another air-fuel ratio sensor is a so-called $O_2$ sensor that outputs a voltage having the characteristics shown in FIG. 4. The $O_2$ sensor outputs a voltage of substantially 0 V when the air-fuel ratio of the exhaust gas is leaner than the stoichiometric air-fuel ratio, and outputs a voltage of substantially 1 V when the air-fuel ratio of the exhaust gas is richer than the stoichiometric air-fuel ratio. The output voltage varies sharply and crosses 0.5 V when the air-fuel ratio of the exhaust gas is in the region of the stoichiometric air-fuel ratio. That is, the $O_2$ sensor outputs voltages that are constant and differ depending upon whether the air-fuel ratio of the exhaust gas is lean or rich relative to the stoichiometric air-fuel ratio.

In the embodiment of the present invention, the air-fuel ratio sensors 11, 12, which are disposed upstream from the three-way catalysts 8, 9, and the air-fuel ratio sensors 13, which are disposed between the three-way catalysts and the NOx catalyst 10 may be linear air-fuel ratio sensors, and the air-fuel ratio sensor 14 downstream from the NOx catalyst may be an $O_2$ sensor.

As shown in FIG. 1, the internal combustion engine of the embodiment has charcoal canister 32 that houses activated charcoal 31 for adsorbing and storing fuel vapor from the fuel tank 30. An internal space 33 at one end of the activated charcoal 31 inside the canister 32 is communicatively connected, via the vapor passage 34, with the inside of the fuel tank 30, and is also communicatively connected, via the purge passage 35, with the intake pipe 4 downstream from the throttle valve 36. A purge control valve 37 adjusting the flow path surface area of the purge passage 35 is disposed in the purge passage 35. When the purge control valve 37 opens, the internal space 33 in the canister 32 is communicatively connected, via the purge path, to the intake pipe 4. An internal space 38 of the canister 32 on the other side of the activated charcoal 31 is communicatively connected to the outer atmosphere via the air pipe 39.

As described above, although fuel vapors generated within the fuel tank 30 are adsorbed and stored by the activated charcoal 31 of the canister 32, because there is a limit to the amount of vapor that the activated charcoal 31 can adsorb and store, it is necessary to remove the vapor from the activated charcoal 31 before the activated charcoal 31 is saturated with vapor. Given this, in this embodiment during operation of the internal combustion engine, when a prescribed condition is satisfied, the purge control valve 37 is opened and the vapor in the activated charcoal 31 is discharged via the purge passage 35 to the intake pipe 4. In the present invention the discharge of vapor to the intake pipe via the purge passage is known as "purge."

During engine operation, negative pressure (hereinafter "intake pipe negative pressure") is generated in the intake pipe 4 downstream from the throttle valve 36. Therefore, when the purge-control valve 37 opens, the negative intake pipe negative pressure is introduced to the canister 32 via the purge passage 35. By this negative pressure introduced in this manner, outside air in the atmosphere is drawn into the canister 32 via the air pipe 39, and the drawn-in air is drawn into the intake pipe 4 via the purge passage 35. When this occurs, fuel vapor that was adsorbed and stored by the activated charcoal 31 is released into the air passing through the canister 32 and is introduced into the intake pipe 4.

In this embodiment, the amount of fuel injected (hereinafter "fuel injection amount") from each of the fuel injection valves is controlled so that the air-fuel ratio of the gas mixture filling the cylinders will be the stoichiometric air-fuel ratio. Next, a method according to the present invention for controlling the air-fuel ratio of the gas mixture filling the cylinders to be at the stoichiometric air-fuel ratio is described. In this specification, the term engine air-fuel ratio refers to the air-fuel ratio of the gas mixture that fills the cylinders, and means the ratio of the amount of air supplied to each cylinder to the amount of fuel supplied to each cylinder. The exhaust air-fuel ratio means the air-fuel ratio of the exhaust gas, meaning the ratio of air supplied to each cylinder (including the air supplied to the engine exhaust passage in a system in which it is possible to supply air to the exhaust passage) to the amount of the amount of fuel supplied to each cylinder (including the fuel supplied to the engine exhaust passage in a system in which it is possible to supply fuel to the engine exhaust passage).

In the internal combustion engine shown in FIG. 1, the time TAU during which the fuel injection valve is open (hereinafter "fuel injection time) is basically calculated by the Equation (1).

$$TAU=TP\cdot FW\cdot(FAF+KGj-FPG) \quad (1)$$

In the above equation, TP is the basic fuel injection time, FW is a correction coefficient, FAF is a feedback correction coefficient, KGj is a learning coefficient of the engine air-fuel ratio, and FPG is a purge air-fuel ratio correction coefficient (hereinafter "purge A/F correction coefficient").

The basic fuel injection time TP is a experimentally determined injection time required to make the engine air-fuel ratio be the stoichiometric air-fuel ratio, this being stored beforehand in an ECU (electronic control unit) as a function of the engine load Ga/N (intake air amount Ga/engine rpm N) and the engine rpm N.

The correction coefficient FW collectively represents such coefficients as the added warm-up amount coefficient and added acceleration amount coefficient, and is set to FW=1.0 if addition amount correction is not required. The feedback correction coefficient FAF is a coefficient for controlling the engine air-fuel ratio so that it is the stoichiometric air-fuel ratio, based on the output signals from the linear air-fuel ratio sensors 11, 12. The purge A/F correction coefficient FPG is made zero during the period of time from the start of engine operation until purge is started, and is increased the higher the fuel vapor concentration in the purge gas is, after purge starts. If engine operation is temporarily stopped, FPG is made zero while purge is stopped.

As described above, the feedback correction coefficient FAF is for the purpose of controlling the air-fuel ratio so that it is the stoichiometric air-fuel ratio, based on the output signals from the linear air-fuel ratio sensors 11, 12.

Figure 5:
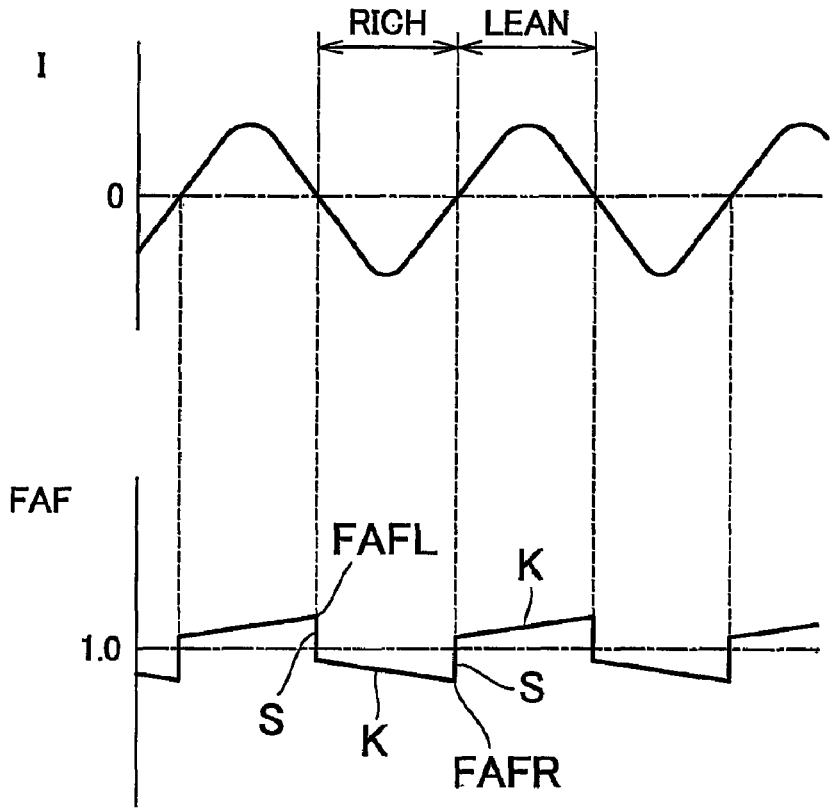
FIG. 5 is a drawing showing the relationship between the output current I of a linear air-fuel ratio sensor and the feedback correction coefficient FAF when the engine air-fuel ratio is maintained as the stoichiometric air-fuel ratio.

FIG. 5 shows the relationship between the output current I of a linear air-fuel ratio sensor and the feedback correction coefficient FAF when the engine air-fuel ratio is maintained at the stoichiometric air-fuel ratio. As shown in FIG. 5, if the output current I of the linear air-fuel ratio sensors 11, 12 is lower than a reference current, for example, 0 (A), that is, if the engine air-fuel ratio is rich, the feedback correction coefficient FAF is caused to decreases rapidly by the skip amount S, and is then caused to decrease gradually with a constant of integration of K. If the output current I of the linear air-fuel ratio sensors 11, 12 is higher than the reference value, that is, if the engine air-fuel ratio is lean, the feedback correction coefficient FAF is caused to increase by the skip amount S, and is then caused to increase gradually with the constant of integration of K.

That is, when the engine air-fuel ratio is rich, the feedback correction coefficient FAF is reduced and the fuel injection amount is reduced, but when the engine air-fuel ratio is lean, the feedback correction coefficient FAF is increased and the fuel injection amount is increased, engine air-fuel ratio is controlled in this manner to be the stoichiometric air-fuel ratio. When this is done, the feedback correction coefficient FAF, as shown in FIG. 5, fluctuates about the reference value, which is 1.0.

In FIG. 5, FAFL indicates the value of the feedback correction coefficient FAF when the engine air-fuel ratio changes from lean to rich, and FAFR indicates the value of feedback correction coefficient FAF when the engine air-fuel ratio changes from rich to lean. In this embodiment, the average value of this FAFL and FAFR is used as the moving average value (hereafter "average value") of the feedback correction coefficient FAF.

By controlling the fuel injection amount as noted above, control should basically be performed so that the engine air-fuel ratio is the stoichiometric air-fuel ratio. However, if there is an error in the outputs of the linear air-fuel ratio sensors 11, 12, the engine air-fuel ratio is not controlled so as to be the stoichiometric air-fuel ratio. For example, if there is a tendency for the linear air-fuel ratio sensor to output a current value corresponding to a air-fuel ratio that is offset to the rich side from the current value corresponding to the actual air-fuel ratio, even if the exhaust air-fuel ratio is the stoichiometric air-fuel ratio, the actual exhaust air-fuel ratio is richer than the stoichiometric air-fuel ratio. For this reason, the fuel injection amount will be small, and, as a result, the engine air-fuel ratio will be controlled so as to be leaner than the stoichiometric air-fuel ratio. On the other hand, if there is a tendency for the linear air-fuel ratio sensor to output a current value corresponding to a air-fuel ratio that is offset to the lean side from the current value corresponding to the actual air-fuel ratio, even if the exhaust air-fuel ratio is the stoichiometric air-fuel ratio, the engine air-fuel ratio will controlled so as to be richer than the stoichiometric air-fuel ratio.

Given the above, in this embodiment output errors in the linear air-fuel ratio sensors 11, 12 are compensated by using the output value of the $O_2$ sensor 14 downstream from the NOx catalyst 10. That is, if there is no output error in the linear air-fuel ratio sensor, and the engine air-fuel ratio is controlled to be the stoichiometric air-fuel ratio, the air-fuel ratio of the exhaust gas flowing out of the NOx catalyst should be the stoichiometric air-fuel ratio, at which time the $O_2$ sensor outputs 0.5 V (hereafter, the "reference voltage value") that corresponds to the stoichiometric air-fuel ratio.

However, if there is an error in the outputs of the linear air-fuel ratio sensors 11, 12, for example, if the engine air-fuel ratio is controlled to be richer than the stoichiometric air-fuel ratio, the air-fuel ratio of the exhaust gas flowing out of the NOx catalyst 10 will be richer than the stoichiometric air-fuel ratio. When this occurs, the $O_2$ sensor 14 outputs a voltage value that corresponds to an air-fuel ratio that is richer than the stoichiometric air-fuel ratio. The difference voltage value output from the $O_2$ sensor and the reference voltage value represents the output error of the linear air-fuel ratio sensor. Given this, the output current value of the linear air-fuel ratio sensor is corrected based on the difference between the voltage value actually output from the $O_2$ sensor and the reference voltage value, so as to compensate for the output error of the linear air-fuel ratio sensor.

On the other hand, if there is an error in the outputs of the linear air-fuel ratio sensors 11, 12, and the engine air-fuel ratio is controlled so as to be leaner than the stoichiometric air-fuel ratio, the output current value of the linear air-fuel ratio sensor is corrected based on the difference between the voltage value actually output from the $O_2$ sensor 14 and the reference voltage value, so as to compensate for the output error of the linear air-fuel ratio sensor.

Figure 6:
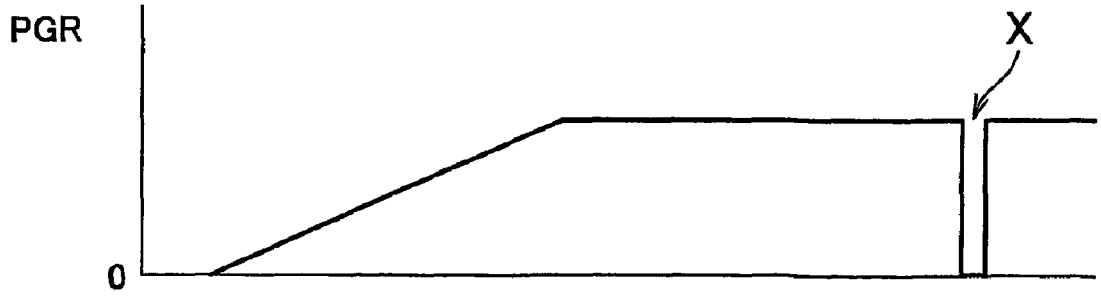
FIG. 6 is a drawing showing purge rate.

FIG. 6 shows the purge rate PGR (in the example of FIG. 1, the proportion of gas mixture (purge gas) of air and vapor purged to the intake pipe 4 from the purge passage 35 with respect to the amount of air taken in from the upstream of the throttle value 36 into the cylinder. As shown in FIG. 6, in this embodiment after the engine starts operating, when purge first starts the purge rate PGR is slowly increased from zero, and when the purge rate PGR reaches a target value (for example 6%), the purge rate PGR is held at the target value thereafter.

If the supply of fuel from the fuel injection valve during deceleration is stopped, for example, the purge rate PGR, as shown by X, changes temporarily to zero. If purge is then restarted, the purge rate PGR becomes the purge rate immediately before the purge was stopped.

Figure 7:
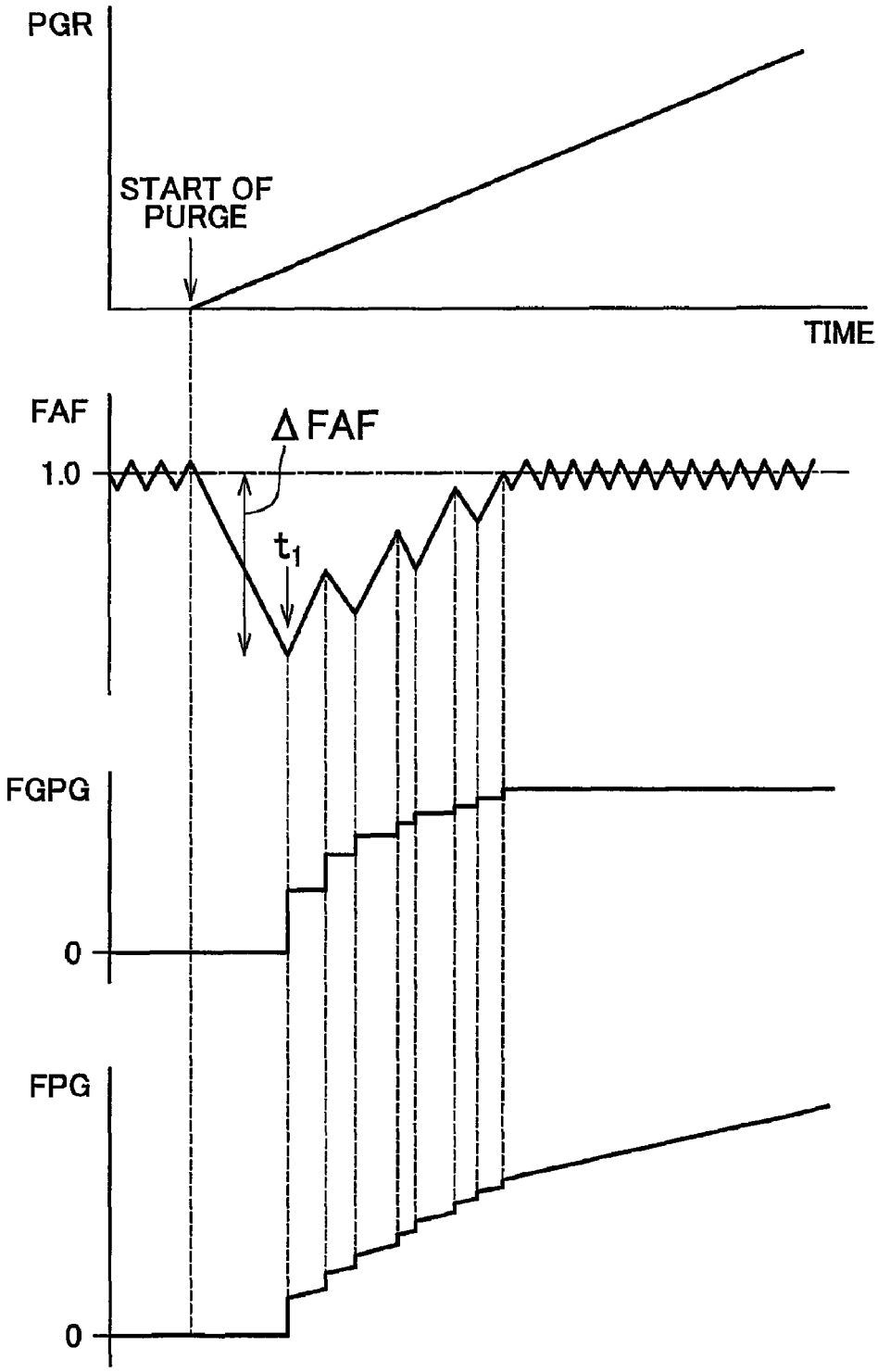
FIG. 7 is a drawing describing the method of learning the fuel vapor concentration in the purge gas.

Next, referring to FIG. 7, a method of learning the vapor concentration in the purge gas (hereinafter "vapor concentration") will be described. The learning of the vapor concentration starts by accurately determining the vapor concentration per unit of purge rate (hereinafter "unit vapor concentration"). In FIG. 7, the unit vapor concentration is indicated as FGPG. The purge A/F correction coefficient FPG is obtained by multiplying the unit vapor concentration FGPG by the purge rate PGR.

The unit vapor concentration FGPG is calculated each time the feedback correction coefficient FAF skips (S in FIG. 5), according to the following Equation (2).

$$FGPG=FGPG+tFP \quad (2)$$

In the above, tFG is the update amount of the unit vapor concentration FGPG performed each skip of the feedback correction coefficient FAF, which is calculated by the following Equation (3).

$$tFG=(1-FAFAV)/(PGR\cdot a) \quad (3)$$

In the above, FAFAV is the feedback correction coefficient average value (=(FAFL+FAFG)/2), and a is set to 2 in this embodiment.

That is, because the engine air-fuel ratio is rich when purge starts, the feedback correction coefficient FAF is reduced to make the engine air-fuel ratio be the stoichiometric air-fuel ratio. Next, at time $t_1$ when it is determined by the linear air-fuel ratio sensors 11, 12 that the air-fuel ratio has switched from rich to lean, the feedback correction coefficient FAF is increased. In this case, the amount of change ΔFAF (=1.0−FAF) of the feedback correction coefficient FAF between the time of the start of purge to the time $t_1$ represents the amount of change in the engine air-fuel ratio caused by the purge, and this amount of change ΔFAF represents the vapor concentration at the time $t_1$.

When time $t_1$ is reached, the engine air-fuel ratio is held at the stoichiometric air-fuel ratio. Thereafter, the unit vapor concentration FGPG is gradually updated so as to return the average value FAFAV of the feedback correction coefficient to 1.0 so that the engine air-fuel ratio does not shift from the stoichiometric air-fuel ratio. When this is done, because the update amount tFG of the unit vapor concentration FGPG each time is made ½ of the amount of offset of the average value FAFAV of the feedback correction coefficient with respect to 1.0, the amount of update tFG, as described above, is tFG=(1−FAFAV)/(PGR·2).

As shown in FIG. 7, when the updating of the unit vapor concentration FGPG is repeated several times, average value FAFAV of the feedback correction coefficient returns to 1.0, after which the unit vapor concentration FGPG remains constant. In this manner, when the unit vapor concentration FGPG becomes constant, FGPG accurately represents the unit vapor concentration, and at that point in time the learning of the unit vapor concentration is completed. The actual vapor concentration is the value obtained by multiplying the unit vapor concentration FGPG by the purge rate PGR. Therefore, purge A/F correction coefficient FPG (=FGPG PGR), which represents the actual vapor concentration, as shown in FIG. 7, is updated each time the unit vapor concentration FGPG is updated, so that it increases with an increase in the purge rate PGR.

Once learning of the unit vapor concentration after the start of the purge is completed, if the unit vapor concentration subsequently changes, the feedback correction coefficient FAF becomes offset from 1.0, and the update amount of the unit vapor concentration FGPG is calculated using the equation tFG=(1−FAFAV)/(PGR·a).

Figure 8:
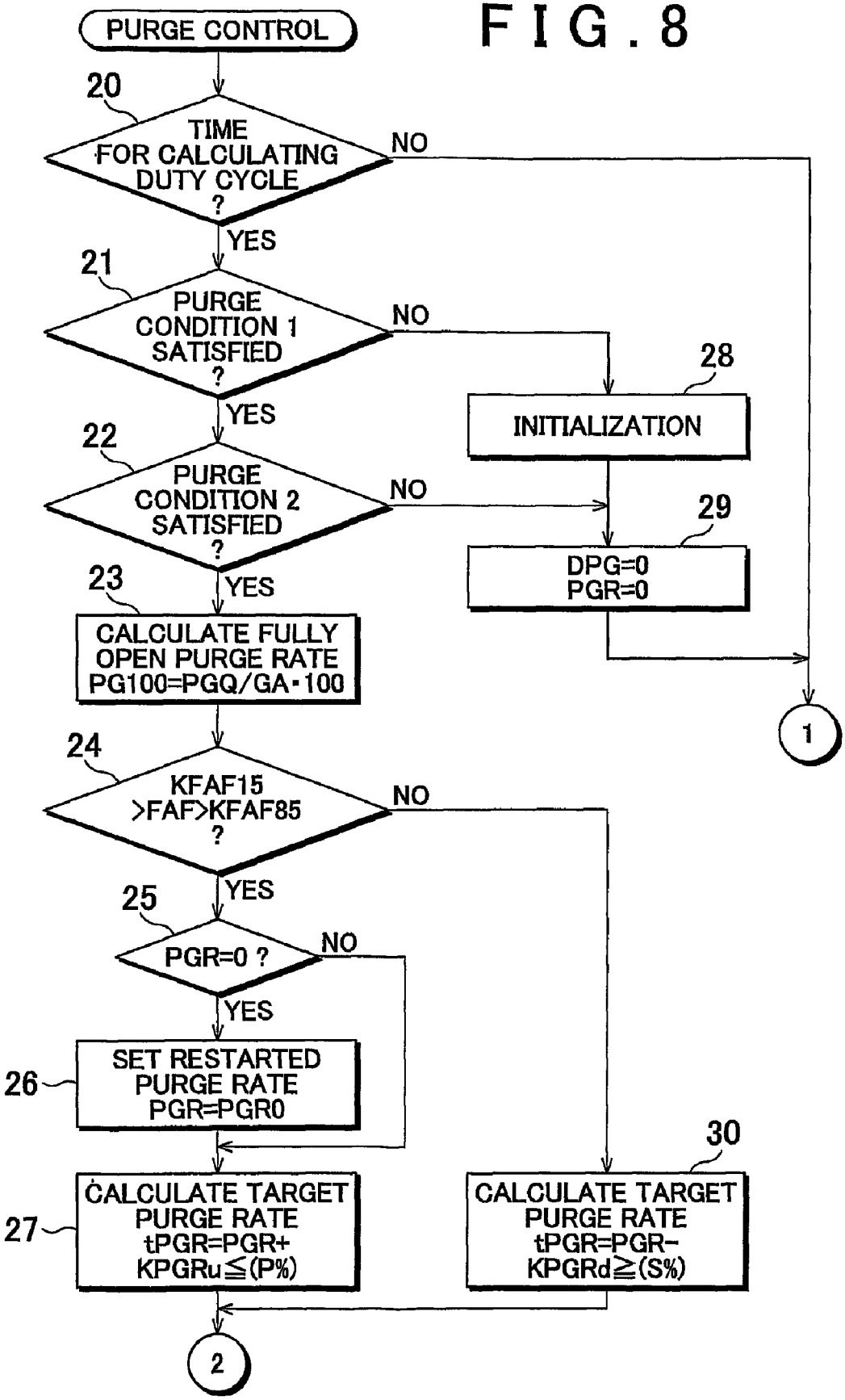
FIG. 8 is a flowchart showing a part of the purge control routine.
Figure 9:
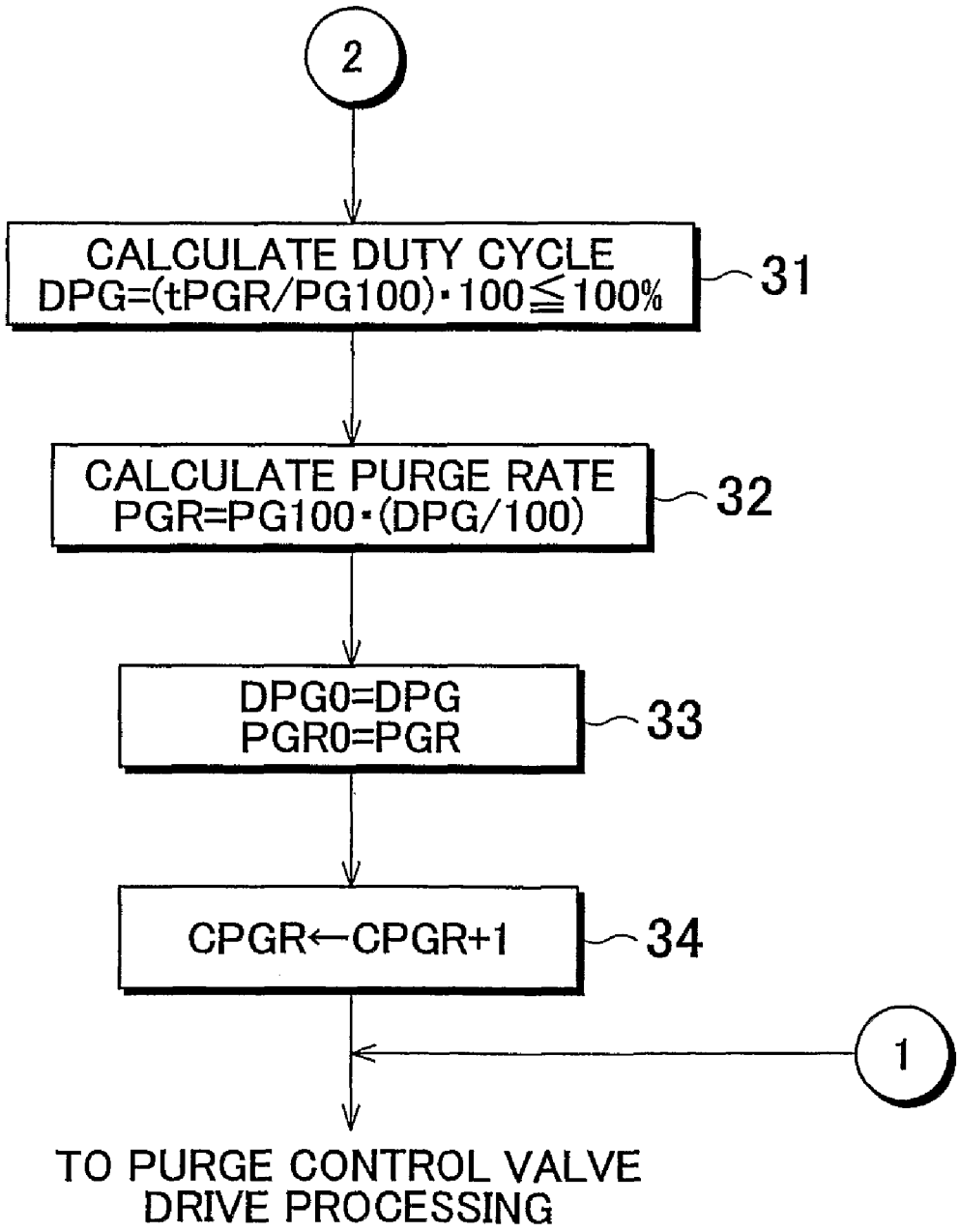
FIG. 9 is a flowchart showing a part of the purge control routine.

Next, referring to FIG. 8 and FIG. 9, the purge control routine will be described. This routine is executed by an interrupt at certain fixed time intervals. The routine shown in FIG. 8 and FIG. 9 first, at step S20, determines whether it is time to calculate the duty cycle of the drive pulse of the purge control valve 37. In this embodiment, the calculation of the duty cycle is performed every 100 ms. If it is determined that it is not the time to calculate the duty cycle, the process proceeds to the drive processing routine for the purge control valve 37 shown in FIG. 10. However, if at step S20 it is determined that it is time to calculate the duty cycle, the process proceeds to step S21, at which it is determined whether a purge condition 1, for example, the completion of warm-up, is satisfied.

At this point, if it is determined that the purge condition 1 is not satisfied, the process proceeds to step S28, at which initialization is performed, that is, at which the purge rate PGRO immediately before the stopping of the purge last time is set to zero, after which the process proceeds to step S29, at which the duty cycle DPG and purge rate PGR are also set to zero. Next, the process proceeds to the drive processing routine for the purge control valve 37 shown in FIG. 10. At step S21, if it is determined that the purge condition 1 is satisfied, the process proceeds to step S22, at which it is determined whether purge condition 2, for example, whether feedback control of the engine air-fuel ratio is performed and whether the supply of fuel from the fuel injection valve is stopped, is satisfied.

Figure 10:
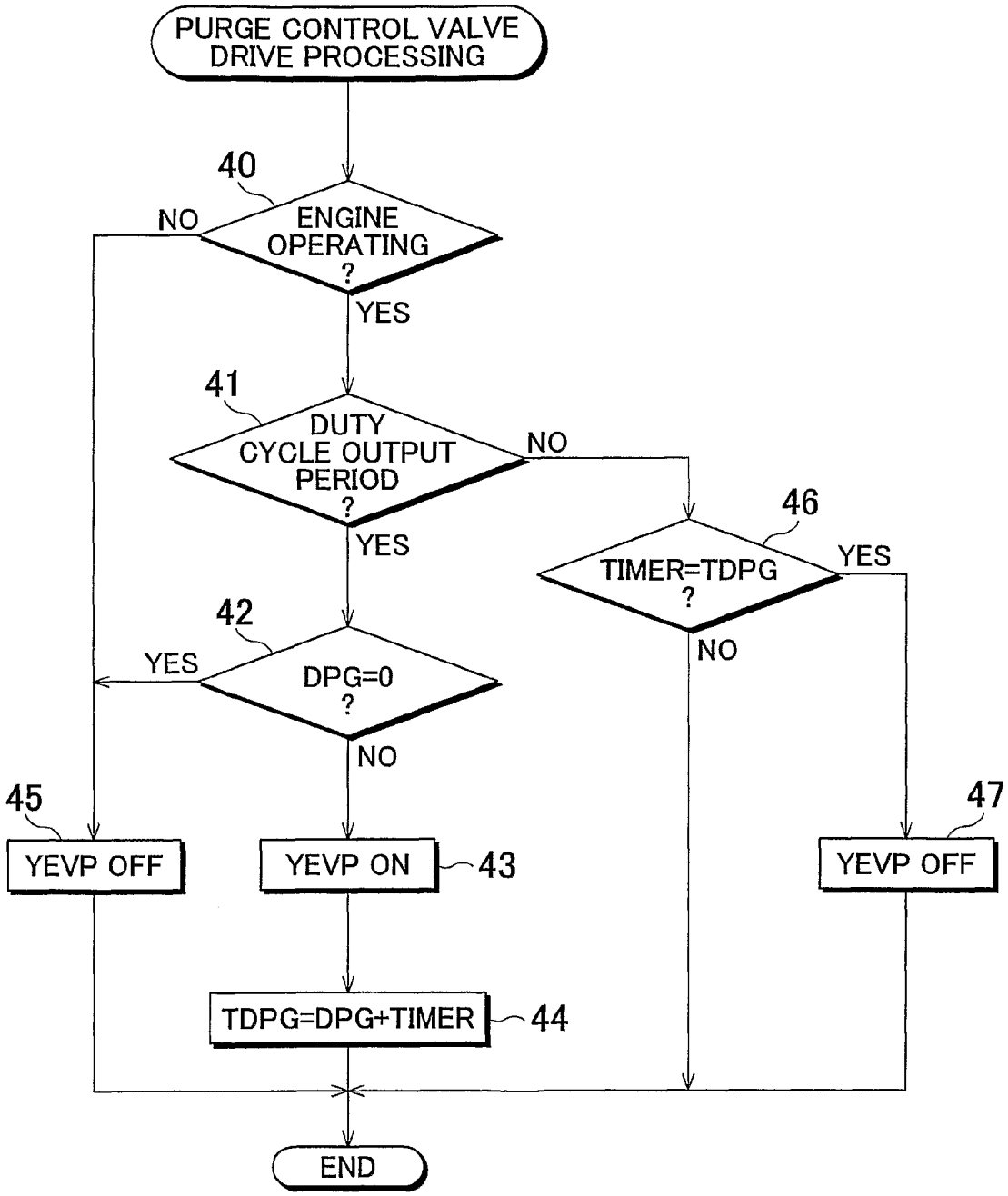
FIG. 10 is a flowchart showing the drive processing routine for the purge control valve.

If it is determined that the purge condition 2 is not satisfied, the process proceeds to step S29, at which the duty cycle DPG and the purge rate PGR are set to zero, after which process proceeds to the drive processing routine for the purge control valve 37 shown in FIG. 10. If it is determined at step S22 that the purge condition 2 is satisfied, however, the process proceeds to step S23.

At step S23, the fully open purge rate PG100 is calculated. The fully open purge rate PG100 is the ratio between the fully open purge amount PGQ and the intake air amount Ga ((PGQ/Ga)·100), this being, for example, an experimentally predetermined function of engine load Ga/N (=intake air amount Ga/engine rpm N) and the engine rpm N, which is stored beforehand in the form of a map, such as shown in Table 1, in an ECU or the like. The fully open PGQ represents the purge gas amount when the purge control valve 37 is fully open.

TABLE 1

| | Ga/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.6 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

Since the smaller the engine load Ga/N becomes, the larger the fully open purge amount PGQ becomes with respect to the air intake amount Ga and, as shown in Table 1, the fully open purge rate PG100 becomes larger the lower the engine load Ga/N is. Also, since the fully open purge rate PGQ with respect to the intake air amount Ga becomes larger the lower the engine rpm N is and, as shown in Table 1, the fully open purge rate PG100 becomes larger the lower the engine rpm N is.

Next, at step S24 it is determined whether the feedback correction coefficient FAF is between the upper limit value KFAF15 (=1.15) and the lower limit value KFAF85 (=0.85) (that is, whether KFAF15>FAF>KFAF85). At this point, if it is determined that KFAF15>FAF>KFAF85 is satisfied, (at this time the engine air-fuel ratio is being feedback controlled to be the stoichiometric air-fuel ratio), the process proceeds to step S25, at which it is determined whether the purge rate PGR is zero (PGR=0).

If it is determined that PGR≠0 (because the purge rate PGR is always zero or greater, if PGR≠0 it means that PGR>0, meaning that purge is being performed), the process skips to step S27. If it is determined at step S25 that PGR=0 (that is, that purge is not being performed), the process proceeds to step S26, at which point the purge rate PGR is set to purge rate (restart purge rate) PGRO immediately before the stopping of the previous purge. At this point, if the process proceeds to step S26 for the first time after engine operation starts (that is, in the case in which the purge condition 1 is satisfied for the first time after the engine operation starts), because the initialization processing at step S28 sets the purge rate PGRO for the immediately before the stopping of the last purge last time to zero by initialization processing, at step S26 the purge rate PGR is made zero. When the process is not proceeding to step S26 for the first time after the engine operation is started, however (that is, in the case in which the purge is restarted after being interrupted) at step S26 the purge rate PGR is made the purge rate PGRO immediately before the stopping of the last purge.

Next, at step S27, by adding a constant value KPGRu to the purge rate PGR, the target purge rate tPGR (=PGR+KPGRu) is calculated, after which process proceeds to step S31. That is, when the feedback correction coefficient FAF is between the upper limit value KFAF15 and the lower limit value KFAF85, the target purge rate tPGR is caused to gradually increase every 100 ms. As shown at step S27, because an upper limit P (for example, 6%) is set for the target purge rate tPGR, the target purge rate tPGR only rises as far as the upper limit value P.

At step S24, if it is determined that FAF≧KFAF15 or FAF≦KFAF85, the process proceeds to step S30, at which the target purge rate tPGR (=PGR−KPGRd) is calculated by subtracting a constant value KPGRd from the purge rate PGR, after which the process proceeds to step S31. That is, when the feedback correction coefficient FAF is not controlled so that it falls between the upper limit value KFAF15 and the lower limit value KFAF85, that is, when the engine air-fuel ratio is not controlled by the stoichiometric air-fuel ratio, it is determined that the effect of the purge is that the engine air-fuel ratio is not controlled to be the stoichiometric air-fuel ratio, and the target purge rate tPGR is decreased. As shown at step S30, because the lower limit value (for example, 0%) is set with respect to the target purge rate tPGR, the target purge rate tPGR is not reduced beyond the lower limit value S.

At step S31, the target purge rate tPGR is divided by the fully open purge rate PG100 to calculate the drive pulse duty cycle DPG (=(tPGR/PG100)·100) of the purge control valve 37. The valve opening amount of the purge control valve 37 is controlled in response to the drive pulse having this duty cycle DPG, that is, in response to the proportion of target purge rate tPGR with respect to the fully open purge rate PG100.

Next, at step S32 the fully open purge rate PG100 is multiplied by the duty cycle DPG to calculate the actual purge rate PGR (=PG100·(DPG/100)). Next, at step S33, the duty cycle DGP is made DPGO and the purge rate PGR is made PGRO. Next, at step S34, the purge execution time counter CPGR representing the amount of time from the start of the purge is increased by 1, after which the process proceeds to the drive processing routine for the purge control valve 37 shown in FIG. 10.

Next, the drive processing routine for the purge control valve 37 shown in FIG. 10 is described. In the routine of FIG. 10, first at step S40 it is determined whether the engine is operating. At this point, if it is determined that the engine is operating, the process proceeds to step S41. If the engine is not operating, however, that is, if it is determined that the engine operation is stopped, the process proceeds to step S45, at which the drive pulse YEVP of the purge control valve 37 is set to off.

At step S41, it is determined whether the output period of the duty cycle is in progress, that is, whether the drive pulse of the purge control valve 37 is in the raised period. The output period of the duty cycle is 100 ms. At step S41 if it is determined that the output period of the duty cycle is in progress, the process proceeds to step S42, at which point it is determined whether the duty cycle DPG is zero (DPG=0). At this point, if it is determined that DPG=0, the process proceeds to step S45, at which the drive pulse YEVP of the purge control valve 37 is set to off. If, however, it is determined at step S42 that DPG≠0, the process proceeds to step S43, at which the drive pulse YEVP of the purge control valve 37 is set to on. Next, at step S44, the duty cycle DPG is added to current time TIMER [[so]] to calculate the off time TDPG of the drive pulse (=DPG+TIMER).

If at step S41, however, it is determined that the output period of the duty cycle is not in progress, the process proceeds to step S46, at which it is determined whether the current time TIMER is at the off time TDPG of the drive pulse (TIMER=TDPG). At this point, if it is determined that TIMER=TDPG, the process proceeds to step S47, at which the drive pulse YEVP is set to off.

Figure 11:
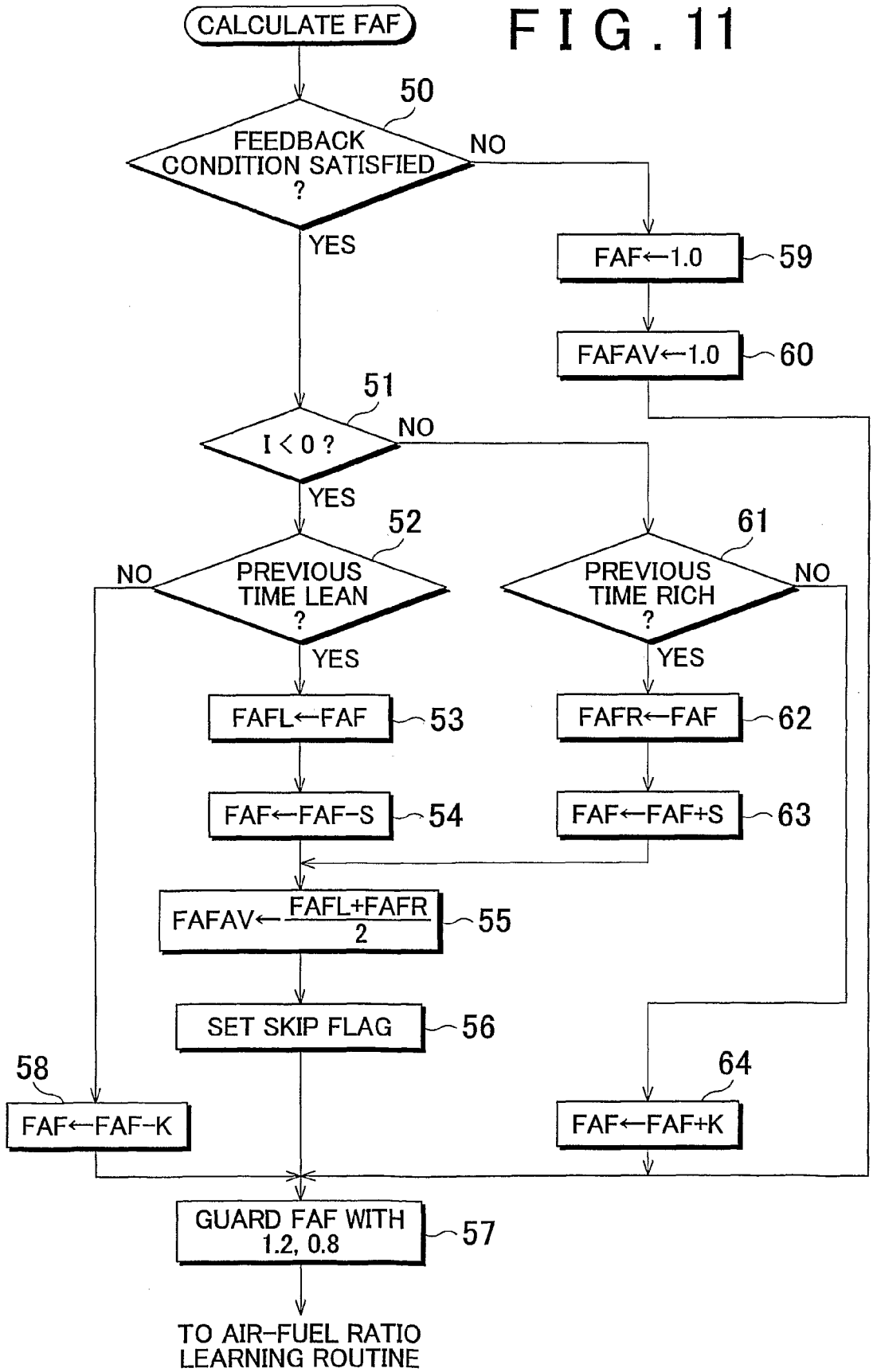
FIG. 11 is a flowchart showing the routine that calculates the feedback correction coefficient.

Next, the routine shown in FIG. 11 that calculates the feedback correction coefficient FAF will be described. This routine is executed, for example, by an interrupt at certain fixed time intervals. In the routine of FIG. 11, at first at step S50 it is determined whether the feedback control condition for the engine air-fuel ratio is satisfied. At this point, if it is determined that the feedback control condition is not satisfied, the process proceeds to step S59, at which the feedback correction coefficient FAF is fixed at 1.0, after which the process proceeds to step S60, at which the average value FAFAV of the feedback correction coefficient is fixed at 1.0, after which the process proceeds to step S64. If at step S50, however, it is determined that the feedback control condition is satisfied, the process proceeds to step S51.

At step S51, it is determined whether the output current I of the linear air-fuel ratio sensors 11, 12 is lower than 0 (A) (I<0), that is, whether the air-fuel ratio is rich. If it is determined that I<0, that is, the air-fuel ratio is rich, the process proceeds to step S52, where it is determined whether the air-fuel ratio was lean at the time of the last execution of this routine. If it is determined that the air-fuel ratio was lean at the time of the last execution of this routine, that is, that between the last execution of this routine and the currently proceeding execution of this routine there was a change from lean to rich, the process proceeds to step S53, at which FAFL is set to FAF, after which the process proceeds to step S54.

At step S54 the skip value S is subtracted from the feedback correction coefficient FAF after which the process proceeds to step S55. By doing this, the feedback correction coefficient FAF is caused to decrease suddenly by the amount of the skip value S.

If at step S52, however, it is determined that the air-fuel ratio was rich for the last execution of this routine also, the process proceeds to step S58, at which a constant of integration K is subtracted from the feedback correction coefficient FAF (K<<S) after which the process proceeds to step S57. By doing this, the feedback correction coefficient FAF is caused to decrease gradually, as shown in FIG. 5.

If, however, it is determined at step S51 that I≧0, that is, the air-fuel ratio is lean, the process proceeds to step S61, at which it is determined whether the air-fuel ratio was rich at the last execution of the routine. If it is determined that the air-fuel ratio was rich at the last execution of this routine, that is, if the judgment is made that the air-fuel ratio changed from rich to lean during the time from the last execution of the routine to the current execution of the routine, the process proceeds to step S62, at which FAFR is set to FAF, after which the process proceeds to step S63.

At step S63, the skip value S is added to the feedback correction coefficient FAF, and then the process proceeds to step S55. By doing this, the feedback correction coefficient FAF is caused to suddenly increase by the skip amount S, as shown in FIG. 5. At step S55, the average value FAFAV is calculated of FAFL, which was calculated at step S53, and FAFR, which was calculated at step S62. Next, at step S56 the skip flag is set, after which the process proceeds to step S57.

At step S61, however, if it is determined that the air-fuel ratio was lean at the last execution of the routine, the process proceeds to step S64, at which the constant of integration K is added to the feedback correction coefficient FAF. By doing this, the feedback correction coefficient FAF is caused to increase gradually, as shown in FIG. 5.

At step 57 the feedback correction coefficient FAF is guarded by limits of variation, the upper limit being 1.2 and the lower limit being 0.8. That is, the value of FAF is guarded so that it does not exceed 1.2 and so that it does not decrease below 0.8. As described above, if the engine air-fuel ratio becomes rich and the FAF is made small, the fuel injection time TAU is shortened and the engine air-fuel ratio transits to the lean side. If the engine air-fuel ratio becomes lean and the FAF is made large, the fuel injection time TAU lengthens and the engine air-fuel ratio transits to the rich side, the engine air-fuel ratio being maintained at the stoichiometric air-fuel ratio.

Figure 12:
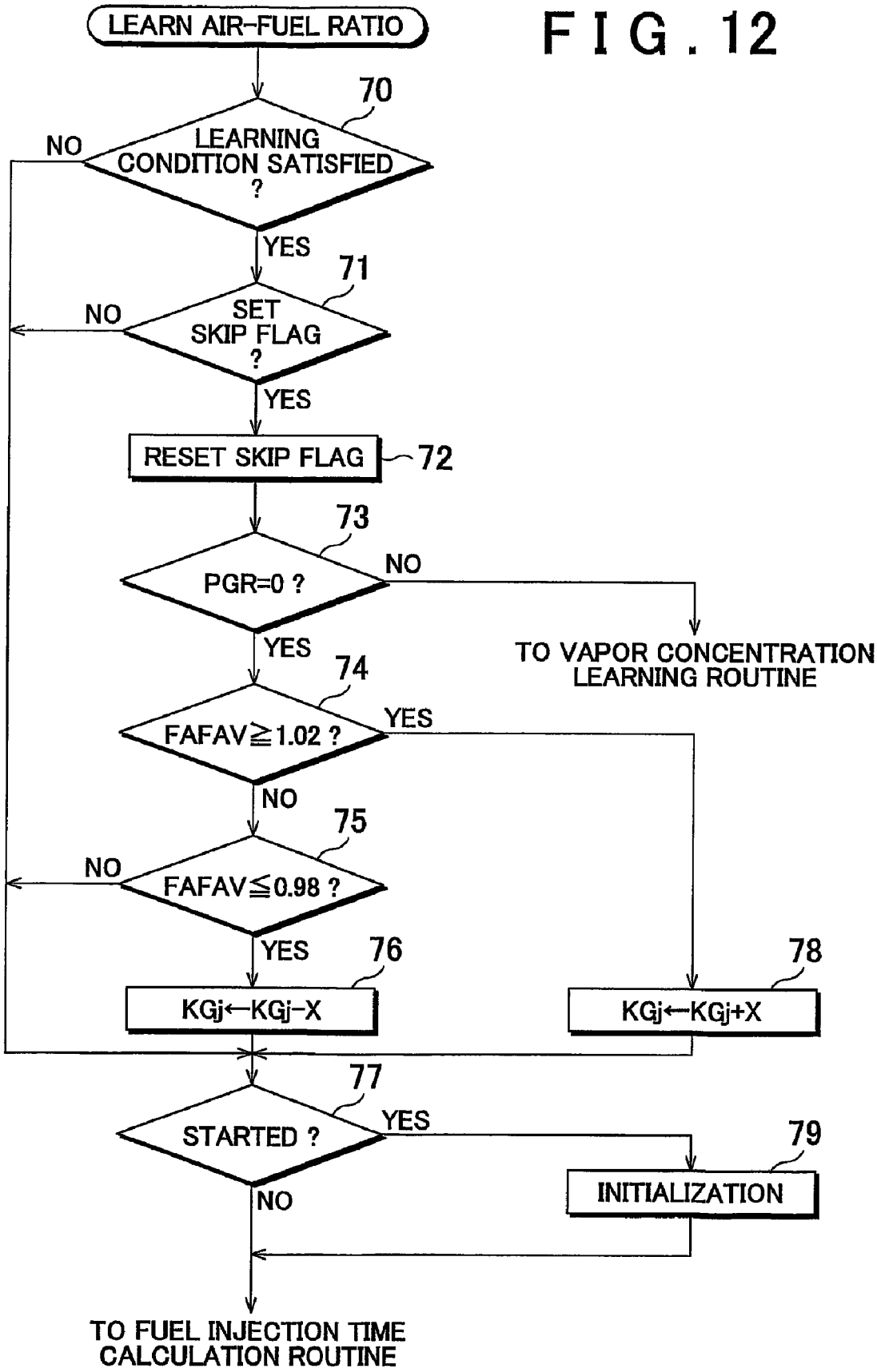
FIG. 12 is a flowchart showing the routine that learns the engine air-fuel ratio.

When the routine for calculation of the feedback correction coefficient FAF shown in FIG. 11 is completed, the process proceeds to the routine for learning the air-fuel ratio shown in FIG. 12. In the routine of FIG. 12, at step S70 it is determined whether the condition for learning the engine air-fuel ratio is satisfied. If it is determined that the condition for learning of the engine air-fuel ratio is not satisfied, the process skips to step S77, and if it is determined that the condition for learning the engine air-fuel ratio is satisfied, the process proceeds to step S71. At step S71, it is determined whether the skip flag is set. At this point, if it is determined that the skip flag is not set, the process skips to step S77, and if the judgment is made that the skip flag is set, the process proceeds to step S72. At step S72 the skip flag is reset and then the process proceeds to step S73. That is, in this routine the process proceeds to step S73 each time the feedback correction coefficient FAF is caused to skip by the amount of the skip value S.

At step S73 it is determined whether the purge rate PGR is zero (PGR=0), that is, whether or not a purge is being performed. If it is determined that PGR≠0, that is, if a purge is being performed, the process proceeds to the routine for learning the vapor concentration shown in FIG. 13. However, if it is determined that PGR=0, that is, that a purge is not being performed, the process proceeds to step S74, in the steps after which the engine air-fuel ratio is learned.

That is, first at step S74, it is determined whether the feedback correction coefficient FAF is greater than 1.02 (FAFAV≧1.02). If it is determined that FAFAV≧1.02, the process proceeds to step S78, at which a constant value X is added to the learned value KGj of the engine air-fuel ratio with respect to the learning region j. That is, in this embodiment, a plurality of learning regions responsive to the engine load, are prepared beforehand, and a learned value KGj is set for the engine air-fuel ratio for each of the learning regions j. At step S78 the learned value KGj of the engine air-fuel ratio of the learning region j responsive to the engine load is updated and the process proceeds to step S77.

At step S74, however, if it is determined that FAFAV<1.02, the process proceeds to step S75, at which it is determined whether average value FAFAV of the feedback correction coefficient FAF is less than 0.98 (FAFAV≦0.98). If it is determined that FAFAV≦0.98, the process proceeds to step S76, at which a constant value X is subtracted from the learned value KGj of the engine air-fuel ratio of the learning region j responsive to the engine load. If, however, at step S75 it is determined that FAFAV>0.98, that is, that FAFAV is between 0.98 and 1.02, the process skips to step S77 without updating the learned value KGj of the engine air-fuel ratio.

At step S77 and step S79, initialization is performed for the purpose of learning the vapor concentration. That is, at step S77, it is determined whether the engine is started. If it is determined that the engine is started, the process proceeds to step S79, at which the unit vapor concentration FGPG is made zero, the purge execution time count value CPGR is cleared, and the process proceeds to the routine that calculates the air-fuel ratio, shown in FIG. 14. If, however, at step S77 it is determined that the engine is not started, the process proceeds to the routine for calculating the fuel injection time, shown in FIG. 14.

Figure 13:
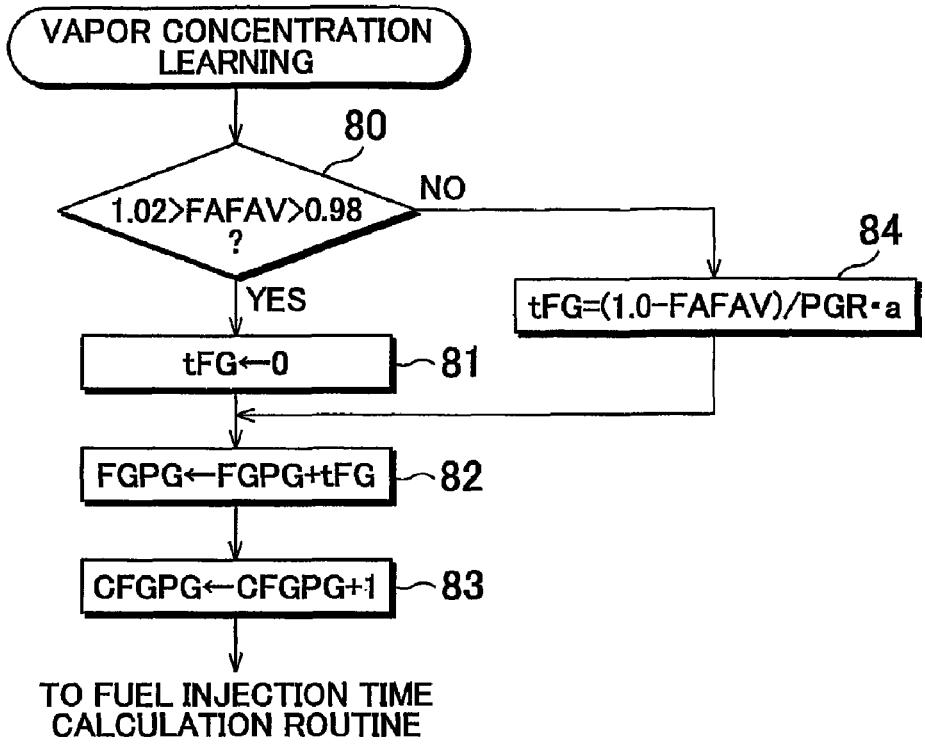
FIG. 13 is a flowchart showing the routine that learns the fuel vapor concentration.

As described above, at step S73 when it is determined that a purge is being performed, the process proceeds to the routine for learning the vapor concentration, shown in FIG. 13. Next, this vapor concentration learning routine will be described. In the routine of FIG. 13, first at step S80 it is determined whether the average value FAFAV of the feedback correction coefficient is within a given setting range, that is whether 1.02>FAFAV>0.98. At this point, if it is determined that 1.02>FAFAV>0.98, the process proceeds to step S81, at which the update amount tFG of the unit vapor concentration FGPG is made zero, after which the process proceeds to step S82.

At step S82, the update amount tFG is added to the vapor concentration FGPG. However, in proceeding to step S82 via step S81, because the update amount tFG is zero, in this case the vapor concentration FGPG is not updated.

If, however, at step S80 it is determined that FAFAV≧1.02 or FAFAV≦0.98, the process proceeds to step S84, at which the update amount tFG of the fuel vapor concentration FGPG is calculated by the following Equation 3.

$$tFG=(1.0-FAFAV)/PGR\cdot a \quad (3)$$

In the above, a is 2. That is, if the average value FAFAV of the feedback correction coefficient FAF exceeds the set range (the range between 0.98 and 1.02), at step S84 one-half of the offset amount of FAFAV with respect to 1.0 is taken as the update amount tFG, and the process proceeds to step S82.

As described above, at step S82 the update amount tFG is added to the vapor concentration FGPG. In proceeding to step S82 via step S84, because the update amount tFG is not zero, the vapor concentration FGPG is updated.

Figure 14:
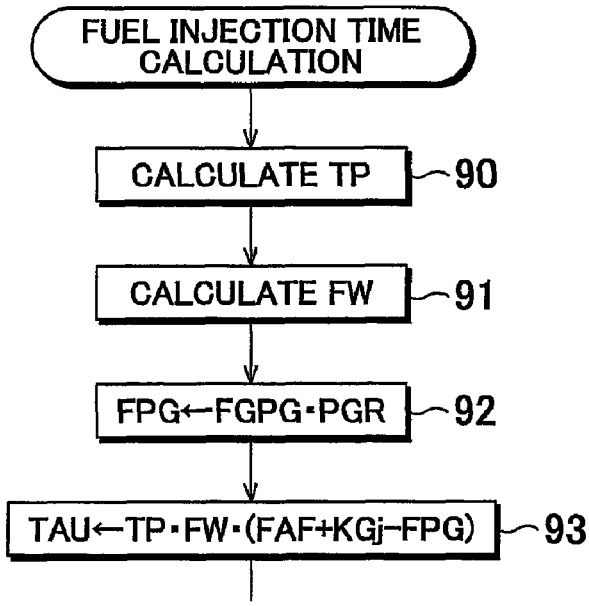
FIG. 14 is a flowchart showing the routine that calculates the fuel injection time.

At step S83, the update number of times counter CFGPG representing the number of updates of the vapor concentration FGPG is increased by 1, after which the process proceeds to the routine that calculates the fuel injection time, shown in FIG. 14.

Next, the routine that calculates the fuel injection time, shown in FIG. 14, is described. In the routine of FIG. 14, at step S90 the basic fuel injection time TP is calculated based on the engine load Ga/N and the engine rpm N, after which at step S91, the correction coefficient FW for warm-up amount and the like is calculated. Next, at step S92, by multiplying the unit vapor concentration FGPG by the purge rate PGR, the purge A/F correction coefficient FPG (=FGPG·PGR) is calculated, after which at step S93, the fuel injection time TAU is calculated in accordance with the following Equation (4).

$$TAU=TP\cdot FW\cdot(FAF+KGj-FPG) \quad (4)$$

As described above, in this embodiment when there is the need to remove SOx from the NOx catalyst 10, sulfur-poisoning recovery control is executed. That is, the air-fuel ratio of the gas mixture that fills the cylinders is controlled so that in addition to discharging rich exhaust gas from cylinder #1 and cylinder #4 of the first cylinder group 1, lean exhaust gas is discharged from cylinder #2 and cylinder #3 of the second cylinder group 2. When this is done, the degree of richness of the rich exhaust gas and the degree of leanness of the lean exhaust gas discharged from each of the cylinders are adjusted so that when the rich exhaust gas and lean exhaust gas are mixed together in the NOx catalyst the overall air-fuel ratio of the exhaust gas is the stoichiometric air-fuel ratio or a desired rich air-fuel ratio.

Next, the control of the air-fuel ratio in each of the cylinders during sulfur poisoning recovery control is described. During sulfur poisoning recovery control, the fuel injection time TAU is calculated in accordance with Equation (5) for the case of the first cylinder group in which combustion is to be done with a rich air-fuel ratio, and the fuel injection time TAU is calculated in accordance with Equation (6) for the case of the second cylinder group in which combustion is to be done with a lean air-fuel ratio.

$$TAU=TP\cdot KR\cdot FW\cdot(FAF+KGj-FPG) \quad (5)$$

$$TAU=TP\cdot KL\cdot FW\cdot(FAF+KGj-FPG) \quad (6)$$

In the above, TP, FW, FAF, KGj, and FPG, similar to the case of TP, FW, FAF, KGj, and FPG in Equation (1), are, respectively, the basic fuel injection time, the correction coefficient, the feedback correction coefficient FAF, the learning constant of the engine air-fuel ratio, and the purge A/F correction coefficient. KR is a coefficient that is larger than 1, which makes the air-fuel ratio in the first cylinder group richer than the stoichiometric air-fuel ratio, and KL is a coefficient that is smaller than 1, which makes the air-fuel ratio in the second cylinder group leaner than the stoichiometric air-fuel ratio, these being coefficients that experimentally determined beforehand so that when the rich exhaust gas and lean exhaust gas are mixed together in the NOx catalyst the overall air-fuel ratio of the exhaust gas is the stoichiometric air-fuel ratio or a desired rich air-fuel ratio.

During sulfur poisoning recovery control, the output of the linear air-fuel ratio sensor 13 is used in the above-described air-fuel ratio control instead of the outputs of the linear air-fuel ratio sensors 11, 12.

By doing this, during sulfur poisoning recovery control, control is performed of the air-fuel ratio in each cylinder group, so that the air-fuel ratio of the gas mixture flowing into the NOx catalyst 10 is either the stoichiometric air-fuel ratio or a desired rich air-fuel ratio. In this embodiment, during sulfur poisoning recovery control when purge is performed, the vapor concentration within the purge gas is basically learned by the above-described method of learning the vapor concentration.

According to the method for learning the vapor concentration as described above, the vapor concentration is determined by using the vapor concentration that is obtained immediately previously. Accordingly, immediately after the internal combustion engine switches operation in which sulfur poisoning recovery control is not performed (hereinafter, "normal operation") to operation in which sulfur poisoning recovery control is performed (hereinafter "sulfur poisoning recovery operation"), there is a need to use the vapor concentration determined in normal operation in determining the vapor concentration.

According to the method of learning the vapor concentration as described above, however, during normal operation the vapor concentration is determined by using the average value FAFAV of the feedback correction coefficient FAF determined each time the feedback correction coefficient FAF is skipped. The feedback correction coefficient FAF in this case is determined by using the outputs of the linear air-fuel ratio sensors 11, 12. Therefore, ultimately according to the method of learning the vapor concentration as described above, during normal operation the vapor concentration is determined using the outputs of the linear air-fuel ratio sensors 11, 12.

Also, in sulfur poisoning recovery operation, the vapor concentration is determined by using the average value FAFAV of the feedback correction coefficient FAF determined each time the feedback correction coefficient FAF skips. However, the feedback correction coefficient FAF in this case is determined using the output of the linear air-fuel ratio sensor 13.

That is, by doing this, immediately after switching from normal operation of the internal combustion engine to sulfur poisoning recovery operation of the internal combustion engine, the vapor concentration is determined by using the vapor concentration determined using the outputs of the linear air-fuel ratio sensors 11, 12 and the output of the linear air-fuel ratio sensor 13.

The linear air-fuel ratio sensors 11, 12 and the linear air-fuel ratio sensor 13 are the same type of sensors, but with inherent differences in the output characteristics thereof. For this reason, in the case of determining the vapor concentration using the vapor concentration determined using the outputs of the linear air-fuel ratio sensors 11, 12 and the output of the linear air-fuel ratio sensor 13, the determined vapor concentration could differ greatly from the true vapor concentration. Then, in the vapor concentration determined during sulfur poisoning recovery control, this variance is reflected, and the vapor concentration determined during the sulfur poisoning recovery control is often greatly different from the true vapor concentration. Of course, even when the internal combustion engine switches from sulfur poisoning recovery control operation to normal operation, there is often a large difference between the determined vapor concentration and the true vapor concentration in the same manner.

Given the above, in this embodiment when the internal combustion engine switches from normal operation to sulfur poisoning recovery operation or switches from sulfur poisoning recovery operation to normal operation, the vapor concentration that had been determined up until that point in time is reset and the vapor concentration is determined from the start. By doing this, regardless of whether the engine is in normal operation or sulfur poisoning recovery operation, it is possible to accurately determine the vapor concentration, and therefore, because it is possible to control the engine air-fuel ratio so that it is precisely close to the target air-fuel ratio, it is possible to maintain good drivability with reduced exhaust emissions.

Figure 15:
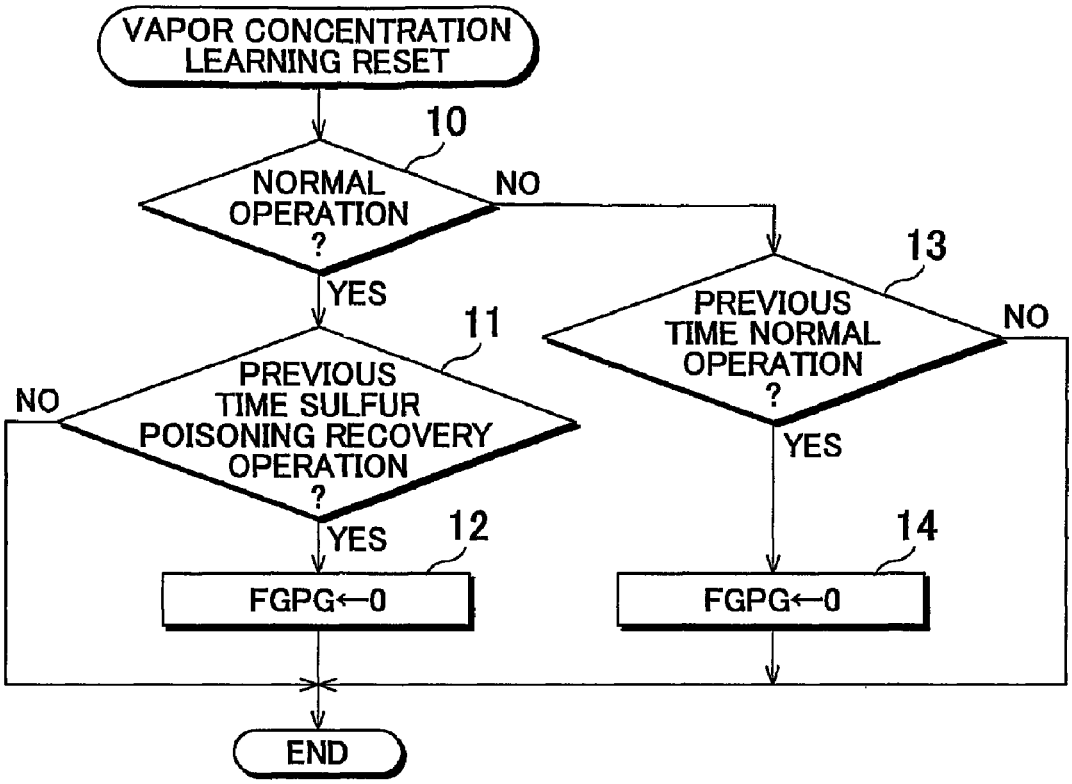
FIG. 15 is a flowchart showing the routing that resets the learned value of fuel vapor concentration according to an embodiment of the present invention.

FIG. 15 shows an example of a routine that resets the learned value of vapor concentration in accordance with the above-described embodiment. In the routine of FIG. 15, first at step S10 it is determined whether normal operation is currently executed. If it is determined that normal operation is being executed, at step 11 it is determined whether the last execution of this routine was done during sulfur poisoning recovery operation. If it is determined that the last execution of this routine was during sulfur poisoning recovery operation, because this means that there has been a switch of the operation of the internal combustion engine from sulfur poisoning recovery operation to normal operation from the last execution to the current execution, at step 12 the learned value of vapor concentration FGPG determined thus far during sulfur poisoning recovery operation is reset to zero. If at step 11, however, it is determined that sulfur poisoning recovery operation is not being executed, because there has not been a switch of the operation of the internal combustion engine from the last execution of this routine to the current execution thereof, the routine ends.

If, however, at step S10 the current operation is not normal operation, meaning that it is sulfur poisoning recovery operation, at step S13 it is determined whether the operation was normal operation the last time this routine was executed. At this point, if it is determined that the current operation is normal operation, because there was a switch from normal operation to sulfur poisoning recovery operation of the internal combustion engine from the last time this routine was executed until the current execution of the routine, at step S14 the learned value of the vapor concentration determined thus far during normal operation is reset to zero. If, however, at step S13 it is determined that the current operation is not normal operation, because there was no switch in the operation of the internal combustion engine between the last execution of the routine and the current execution of the routine, the routine is ended as is.

In the above-described example, the value of the vapor concentration learned thus far is reset when the operation of the internal combustion engine switches from normal operation to sulfur poisoning recovery operation or from sulfur poisoning recovery operation to normal operation. However, when the internal combustion engine, for example, has switched from normal operation to sulfur poisoning recovery operation, the vapor concentration learned thus far may be recorded without resetting the learned value, and in sulfur poisoning recovery operation the vapor concentration is determined without using the learned value of vapor concentration learned during normal operation, after which, when the internal combustion engine operation switches from sulfur poisoning recovery operation to normal operation, the vapor concentration may be determined using the value of vapor concentration learned and recorded during normal operation. Of course when the internal combustion engine switches from sulfur poisoning recovery operation to normal operation as well, the learned value of vapor concentration determined during sulfur poisoning recovery operation may be recorded in the same manner, and at the next sulfur poisoning recovery operation the vapor concentration may be determined using the learned value of vapor concentration that was determined and recorded during sulfur poisoning recovery operation.

In the foregoing embodiment, purge may be performed as described below when the operation of the internal combustion engine is switched. Specifically, when there is a demand to switch the operation of the internal combustion engine from normal operation to sulfur poisoning recovery operation, the purge is stopped and the operation of the internal combustion engine is switched. After a prescribed amount of time has elapsed from the switching of the operation of the internal combustion engine, purge is restarted and the learning of the vapor concentration is started. In the same manner, when there is a demand to switch the operation of the internal combustion engine from sulfur poisoning recovery operation to normal operation, the purge is stopped and the operation of the internal combustion engine is switched. After a prescribed amount of time has elapsed from the switching of the operation of the internal combustion engine, purge is restarted and the learning of the vapor concentration is started. By doing this, during either normal operation or sulfur poisoning recovery operation of the internal combustion engine it is possible to accurately determine the vapor concentration, and because it is thereby possible to control the air-fuel ratio accurately to be the target air-fuel ratio, it is possible to reduce exhaust emissions and maintain good drivability.

Figure 16:
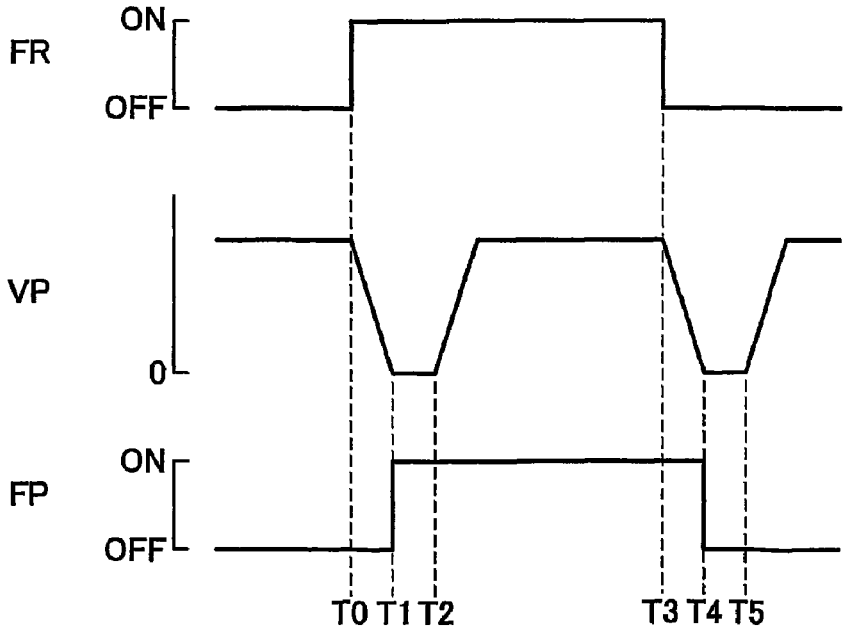
FIG. 16 is a timing diagram showing the condition in which the operation and purge in an internal combustion engine are controlled according to an embodiment of the present invention.

FIG. 16 is a flowchart that shows the condition in which the operation and purge in an internal combustion engine are controlled according to this embodiment. As shown in FIG. 16, before the time T0 the flag FR that requests the performance of sulfur poisoning recovery operation (hereinafter "sulfur poisoning recovery request flag") is off (that is, there is no request to perform sulfur poisoning recovery operation), the purge gas amount VP is the requested amount, and the flag FP that causes execution of the sulfur poisoning recovery operation (hereinafter "sulfur poisoning recovery execution flag") is off (that is, sulfur poisoning recovery operation is not done).

At time T0 is reached, the sulfur poisoning recovery request flag FR is turned on. When this occurs, in this example, the purge and the learning of the vapor concentration are both stopped. At the time T1, when the purge gas amount VP becomes zero, the sulfur poisoning recovery execution flag FP is turned on, at which time the operation of the internal combustion engine switches from normal operation to sulfur poisoning recovery operation. At the time T2, which is after a prescribed amount of time elapses from the time T1, the purge starts and the learning of the vapor concentration starts once again.

At time T3, the sulfur poisoning recovery request flag FR is set to off. When this is done, in this embodiment the learning of the vapor concentration and the purge are stopped. Then, at the time T4, when the purge gas amount VP becomes zero, the sulfur poisoning recovery execution flag FR is set to off, at which time the internal combustion engine operation is switched from the sulfur poisoning recovery operation to normal operation. At the time T5, which is after a prescribed amount of time elapses from the time T4, the purge is restarted and the learning of the vapor concentration is started anew.

Although in the above description, the present invention as applied in the context of sulfur poisoning recovery operation, it is possible to apply the present invention, for example, to the case in which it is necessary to supply a reducing agent (that is, fuel) and air to a NOx catalyst for the purpose of raising the temperature of the NOx catalyst. From this standpoint, the present invention may be widely applied in the case in which, when it is necessary to supply a reducing agent and air to a NOx catalyst, combustion is to be done in one cylinder group at an air-fuel ratio that is richer than the stoichiometric air-fuel ratio, and combustion is to be done in another cylinder group at an air-fuel ratio that is leaner than the stoichiometric air-fuel ratio, so that exhaust gas having a prescribed air-fuel ratio flows into a NOx catalyst.

The above description uses the example of the present invention applied to an internal combustion engine in which a three-way catalyst disposed in each exhaust branch pipe and a NOx catalyst is disposed in a common exhaust pipe. The present invention, however, may also be applied to an internal combustion engine in which the catalyst disposed in each exhaust branch pipe is not a three-way catalyst, but rather a catalyst that purifies a specific component within the exhaust gas, and also to an internal combustion engine in which the catalyst disposed in the common exhaust gas purifying is not a NOx catalyst, but rather an exhaust gas purifying catalyst that purifies a specific component in the exhaust gas.

In the above description the present invention is applied to an internal combustion engine in which a three-way catalyst is disposed in each exhaust branch pipe. However, the present invention may also be applied to an internal combustion engine in which no catalyst is disposed in the exhaust branch pipes.

The above description of the present invention demonstrates the application of the invention in the case where the vapor concentration is determined. The present invention, however, alternatively be applied to cases where the vapor amount in the purge gas is determined.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, fewer, or only a single element, are also within the spirit and scope of the invention.

The invention claimed is:

1. An internal combustion engine comprising:

a plurality of cylinders divided into at least two cylinder groups;

a plurality of exhaust branch pipes, joined near downstream ends, each connected to a cylinder group of the at least two cylinder groups;

a common exhaust pipe connected to the downstream ends, which are joined, of the plurality of exhaust branch pipes;

an exhaust gas purifying catalyst disposed in the common exhaust pipe;

at least one first air-fuel ratio sensor disposed in each of the exhaust branch pipes;

a second air-fuel ratio sensor disposed in the common exhaust pipe upstream from the exhaust gas purifying catalyst; and a controller that is configured to usually perform normal operation, which causes combustion in each cylinder group with a prescribed air-fuel ratio, wherein when there is a need to supply a reducing agent and air to the exhaust gas purifying catalyst, the controller is configured to perform rich-lean operation, which causes combustion with an air-fuel ratio richer than a stoichiometric air-fuel ratio in a first cylinder group and causes combustion with an air-fuel ratio leaner than the stoichiometric air-fuel ratio in a second cylinder group so that exhaust gas having the prescribed air-fuel ratio flows into the exhaust gas purifying catalyst, wherein when a prescribed condition is established, the controller is configured to perform purge control introducing a gas including a fuel vapor into an intake passage leading to all of the plurality of cylinders, and determines and records an amount of fuel vapor introduced into the intake passage during the purge control as a learned value, wherein, during normal operation, when determining the fuel vapor amount introduced into the intake passage during purge control, the controller is configured to determine the fuel vapor amount using an output value of the at least one first air-fuel ratio sensor and a fuel vapor amount determined and recorded as a learned value of fuel vapor amount during normal operation, wherein, during rich-lean operation, when determining the fuel vapor amount introduced into the intake passage during purge control, the controller is configured to determine the fuel vapor amount using an output value of the second air-fuel ratio sensor and a fuel vapor amount determined and recorded as a learned value of fuel vapor amount during rich-lean operation, and wherein the learned value of the amount of fuel vapor introduced into the intake passage during the purge control is reset to zero when the internal combustion engine switches from the normal operation to a sulfur poisoning recovery operation or switches from the sulfur poisoning recovery operation to the normal operation.

2. The internal combustion engine according to claim 1, wherein the controller stops execution of the purge control when operation of the internal combustion engine switches from normal operation to rich-lean operation, or when operation of the internal combustion engine switches from rich-lean operation to normal operation, and wherein the controller resumes execution of the purge control when a prescribed period of time has elapsed after the operation of the internal combustion engine is switched.

3. The internal combustion engine according to claim 1, wherein when normal operation is performed, an air-fuel ratio in each cylinder group is controlled to be a first target air-fuel ratio using the output value of the at least one first air-fuel ratio sensor, and wherein when rich-lean operation is performed, an air-fuel ratio in each cylinder group is controlled to be a second target air-fuel ratio using the output value of the second air-fuel ratio sensor.

4. The internal combustion engine according to claim 1, wherein an exhaust gas purifying catalyst is disposed in each exhaust branch pipe downstream from the at least one first air-fuel ratio sensor.

5. A method of controlling an internal combustion engine that includes a plurality of cylinders divided into at least two cylinder groups;

a plurality of exhaust branch pipes, joined near downstream ends, each connected to a cylinder group of the at least two cylinder groups;

a common exhaust pipe connected to the downstream ends, which are joined, of the plurality of exhaust branch pipes;

an exhaust gas purifying catalyst disposed in the common exhaust pipe;

at least one first air-fuel ratio sensor disposed in each of the exhaust branch pipes;

a second air-fuel ratio sensor disposed in the common exhaust pipe upstream from the exhaust gas purifying catalyst; and a controller that is configured to usually perform normal operation, which causes combustion in each cylinder group with a prescribed air-fuel ratio, wherein when there is a need to supply a reducing agent and air to the exhaust gas purifying catalyst, the controller is configured to perform rich-lean operation, which causes combustion with an air-fuel ratio richer than a stoichiometric air-fuel ratio in a first cylinder group and causes combustion with an air-fuel ratio leaner than the stoichiometric air-fuel ratio in a second cylinder group so that exhaust gas having the prescribed air-fuel ratio flows into the exhaust gas purifying catalyst, wherein when a prescribed condition is established, the controller is configured to perform purge control introducing a gas including a fuel vapor into an intake passage leading to all of the plurality of cylinders, and determines and records an amount of fuel vapor introduced into the intake passage during the purge control as a learned value, the method comprising:

determining, via the controller, whether purge control is in progress;

determining, via the controller, whether normal operation is being performed or rich-lean operation is being performed;

during normal operation, determining, via the controller, the fuel vapor amount using an output value of the at least one first air-fuel ratio sensor and a vapor amount determined and recorded as a learned value of fuel vapor amount during normal operation when determining the fuel vapor amount introduced into the intake passage during purge control;

during rich-lean operation, determining, via the controller, the fuel vapor amount using an output value of the second air-fuel ratio sensor and a fuel vapor amount determined and recorded as a learned value of fuel vapor amount during rich-lean operation when determining the fuel vapor amount introduced into the intake passage during purge control; and resetting the learned value of the amount of fuel vapor introduced into the intake passage during the purge control to zero when the internal combustion engine switches from the normal operation to a sulfur poisoning recovery operation or switches from the sulfur poisoning recovery operation to the normal operation.

6. The internal combustion engine according to claim 1, wherein the plurality of cylinders includes four cylinders in parallel, wherein a first exhaust branch pipe is connected to a first and a fourth cylinder of the four cylinders, the first and the fourth cylinders not being adjacent, and wherein a second exhaust branch pipe is connected to a second and a third cylinder of the four cylinders, the second and the third cylinders being adjacent.

7. The internal combustion engine according to claim 1, wherein the controller performs sulfur poisoning recovery control during rich-lean operation.

8. The method of controlling an internal combustion engine according to claim 5, further comprising:

performing, via the controller, sulfur poisoning recovery control during rich-lean operation.

* * * * *